US008197166B2

(12) United States Patent
Stull et al.

(10) Patent No.: US 8,197,166 B2
(45) Date of Patent: Jun. 12, 2012

(54) TIE DOWN ASSEMBLY

(75) Inventors: Eric M. Stull, Lower Burrell, PA (US); James T. Burg, Verona, PA (US); Franklin David Silvio, Natrona Heights, PA (US); Robert J. Speer, Upper Burrell, PA (US)

(73) Assignee: Alcoa Inc., Pittsburgh, PA (US)

( * ) Notice: Subject to any disclaimer, the term of this patent is extended or adjusted under 35 U.S.C. 154(b) by 172 days.

(21) Appl. No.: 12/723,995

(22) Filed: Mar. 15, 2010

(65) Prior Publication Data

US 2011/0017792 A1 Jan. 27, 2011

Related U.S. Application Data

(60) Provisional application No. 61/216,166, filed on May 14, 2009.

(51) Int. Cl.
*B61D 45/00* (2006.01)

(52) U.S. Cl. ..... 410/106

(58) Field of Classification Search ..... 410/101, 410/106, 107, 112, 116; 248/499, 503, 231.9; 114/218; 24/115 R
See application file for complete search history.

(56) References Cited

U.S. PATENT DOCUMENTS 3,365,162 A * 1/1968 Davis ..... 410/111
3,927,623 A 12/1975 Caron
4,091,744 A * 5/1978 Crissy et al. ..... 410/116
4,099,661 A * 7/1978 Dick et al. ..... 228/107
4,193,529 A * 3/1980 Dick et al. ..... 228/107
4,877,361 A 10/1989 Derosa et al.
4,907,921 A 3/1990 Akright
4,945,849 A 8/1990 Morris et al.
5,052,869 A * 10/1991 Hansen, II ..... 410/111
5,535,694 A 7/1996 Czipri (Continued)

FOREIGN PATENT DOCUMENTS

DE 199 04 366 C1 2/1999

(Continued)

OTHER PUBLICATIONS

Hull Standard Drawing—Aircraft Securing and Engine Run-Up Fittings, Department of the Navy, Naval Ships System Command, Drawing No. F53711803/1916300N, Jul. 11, 2005 (15 pages).

(Continued)

*Primary Examiner* — H Gutman
(74) *Attorney, Agent, or Firm* — Greenberg Traurig, LLP

(57) ABSTRACT

A tie down assembly including a cup, a cross-shaped crossbar that is fastened removably to and positioned within a recess of the cup, and a disc-shaped plate that is fastened removably to the cup and/or the crossbar. The crossbar is fastened to the cup by a plurality of fasteners, while the plate is fastened to the cup and/or the crossbar by at least one fastener. The cup is installed within a hole formed within a first surface of a structure, and the plate is positioned against an opposite surface of the structure. When the plate is attached, a compressive load is introduced and squeezes the first and second surfaces of the structure together, such that most of the load is borne down the center of the fastener attaching the plate.

15 Claims, 25 Drawing Sheets

U.S. PATENT DOCUMENTS

| | | | | |
|---|---|---|---|---|
| 6,764,259 | B1 | 7/2004 | Preta | |
| 6,935,602 | B2 * | 8/2005 | Hardie | 248/499 |
| 7,134,819 | B2 * | 11/2006 | Bullock et al. | 410/102 |
| 7,390,155 | B1 | 6/2008 | Diaz et al. | |
| 8,075,232 | B2 * | 12/2011 | Le | 410/106 |
| 2004/0099197 | A1 | 5/2004 | King | |
| 2006/0054068 | A1 * | 3/2006 | Fockler et al. | 114/218 |
| 2006/0133907 | A1 * | 6/2006 | Bullock et al. | 410/107 |
| 2008/0087782 | A1 | 4/2008 | Sutherland et al. | |
| 2010/0284758 | A1 * | 11/2010 | Le | 410/111 |
| 2011/0210227 | A1 * | 9/2011 | Burg et al. | 248/499 |
| 2011/0284716 | A1 * | 11/2011 | Silvio et al. | 248/503 |

FOREIGN PATENT DOCUMENTS

| | | | |
|---|---|---|---|
| EP | 0 424 083 | A1 | 4/1991 |
| EP | 1 609 717 | A1 | 12/2005 |
| WO | 2009/132390 | A1 | 11/2009 |

OTHER PUBLICATIONS

U.S. Appl. No. 12/853,868, filed Aug. 10, 2010, entitled "Tie Down Assembly" (49 pages, including cover sheet).

U.S. Appl. No. 12/948,931 on "Tie Down Assembly" filed Nov. 18, 2010 (66 pages).

International Search Report and Written Opinion issued in connection with International Patent Application No. PCT/US2010/045048 entitled "Tie Down Assembly" (8 Pages).

International Search Report and Written Opinion issued in connection with International Patent Application No. PCT/US2010/057189 entitled "Tie Down Assembly" (6 Pages).

International Search Report and Written Opinion for PCT/US2010/027317, mailed Jun. 22, 2011.

* cited by examiner

TIE DOWN ASSEMBLY

CROSS-REFERENCE TO RELATED APPLICATION

This application is a Section 111(a) application relating to commonly owned U.S. Provisional Application Ser. No. 61/216,166 entitled "TIE DOWN ASSEMBLY," filed May 14, 2009, the entirety of which is incorporated herein by reference.

STATEMENT REGARDING FEDERALLY SPONSORED RESEARCH OR DEVELOPMENT

The U.S. Government has a paid-up license in this invention and the right in limited circumstances to require the patent owner to license others on reasonable terms as provided for by the terms of U.S. Government Contract No. N00167-07-D-0010 awarded by the Naval Surface Warfare Center, Carderock Division.

FIELD OF THE INVENTION

The present invention relates to a tie down assembly and, more particularly, to a tie down assembly for naval and maritime vessels.

BACKGROUND

Tie down assemblies are commonplace on naval and maritime vessels, as they facilitate the security of cargo, vehicles, such as aircraft, and other heavy items and equipment. Tie down assemblies are typically installed within a deck of the vessel. Tie down assemblies must be secure within the deck and endure heavy loads. In addition, tie down assemblies should be easily repaired and replaced within the deck.

SUMMARY OF THE INVENTION

In an embodiment, a tie down assembly including a cup, a cross-shaped crossbar that is fastened removably to and positioned within a recess of the cup, and a disc-shaped plate that is fastened removably to the cup and the crossbar. In an embodiment, the crossbar is fastened to the cup by a plurality of threaded fasteners, while the plate is fastened to the cup and the crossbar by a threaded fastener. In an embodiment, the cup is installed within a hole formed within a first surface of a structure, and the plate is positioned against an opposite surface of the structure. In an embodiment, when the plate is attached to the cup and the crossbar by tightening the threaded fastener, a compressive load is introduced, which is borne down the center of the fastener. In an embodiment, the plate is attached to the cup by a plurality of fasteners.

BRIEF DESCRIPTION OF THE DRAWINGS

Reference is made to the following detailed description of the exemplary embodiments considered in conjunction with the accompanying drawings, in which.

DETAILED DESCRIPTION OF THE INVENTION

Figure 1B:
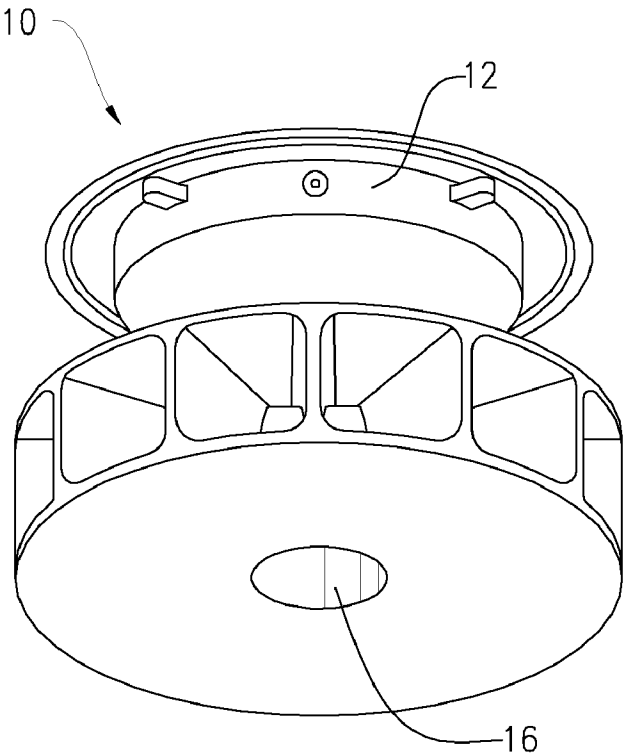
FIG. 1B is a bottom perspective view of the tie down assembly shown in FIG. 1A.
Figure 1A:
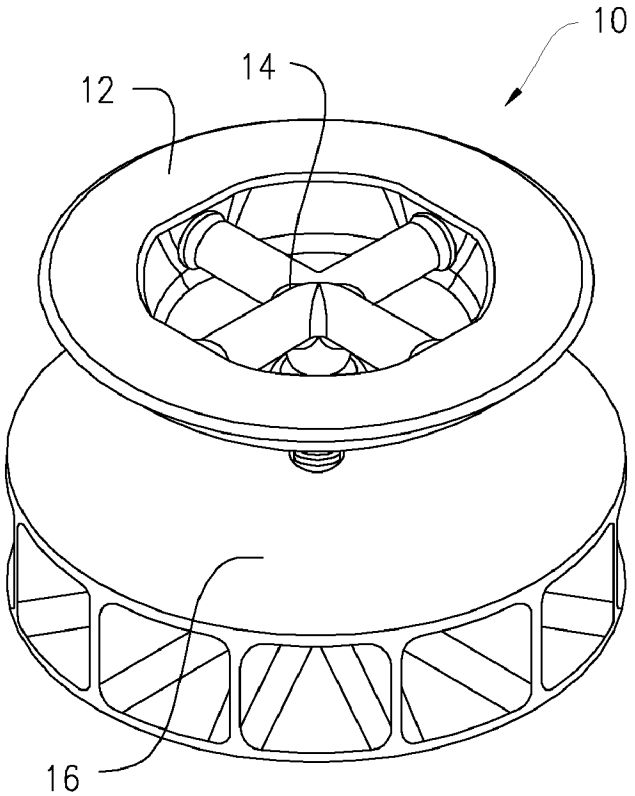
FIG. 1A is a top perspective view of a tie down assembly in accordance with an embodiment of the present invention.
Figure 2B:
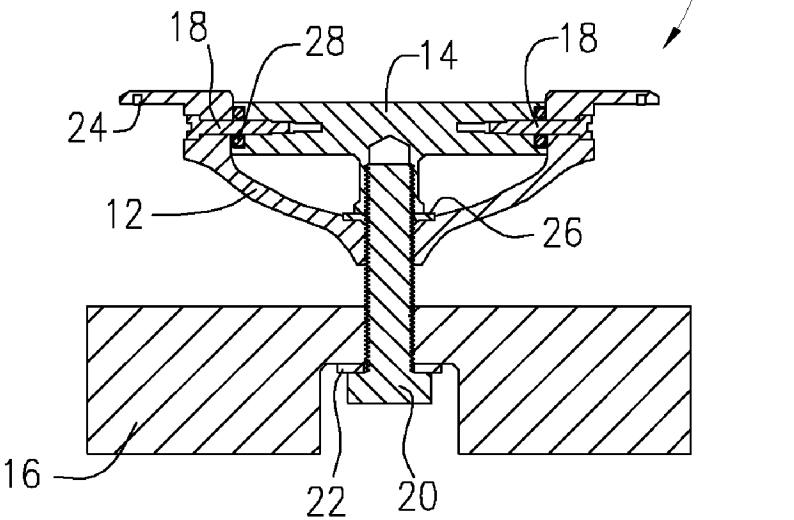
FIG. 2B is a cross-sectional view, taken along line A-A and looking in the direction of the arrows, of the tie down assembly shown in FIG. 2A.
Figure 2A:
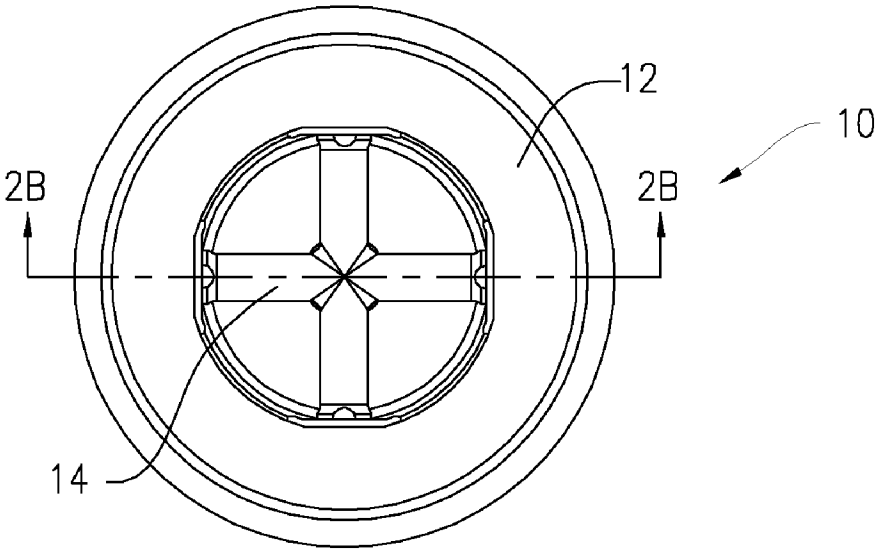
FIG. 2A is a top plan view of the tie down assembly shown in FIG. 1A.
Figure 3A:
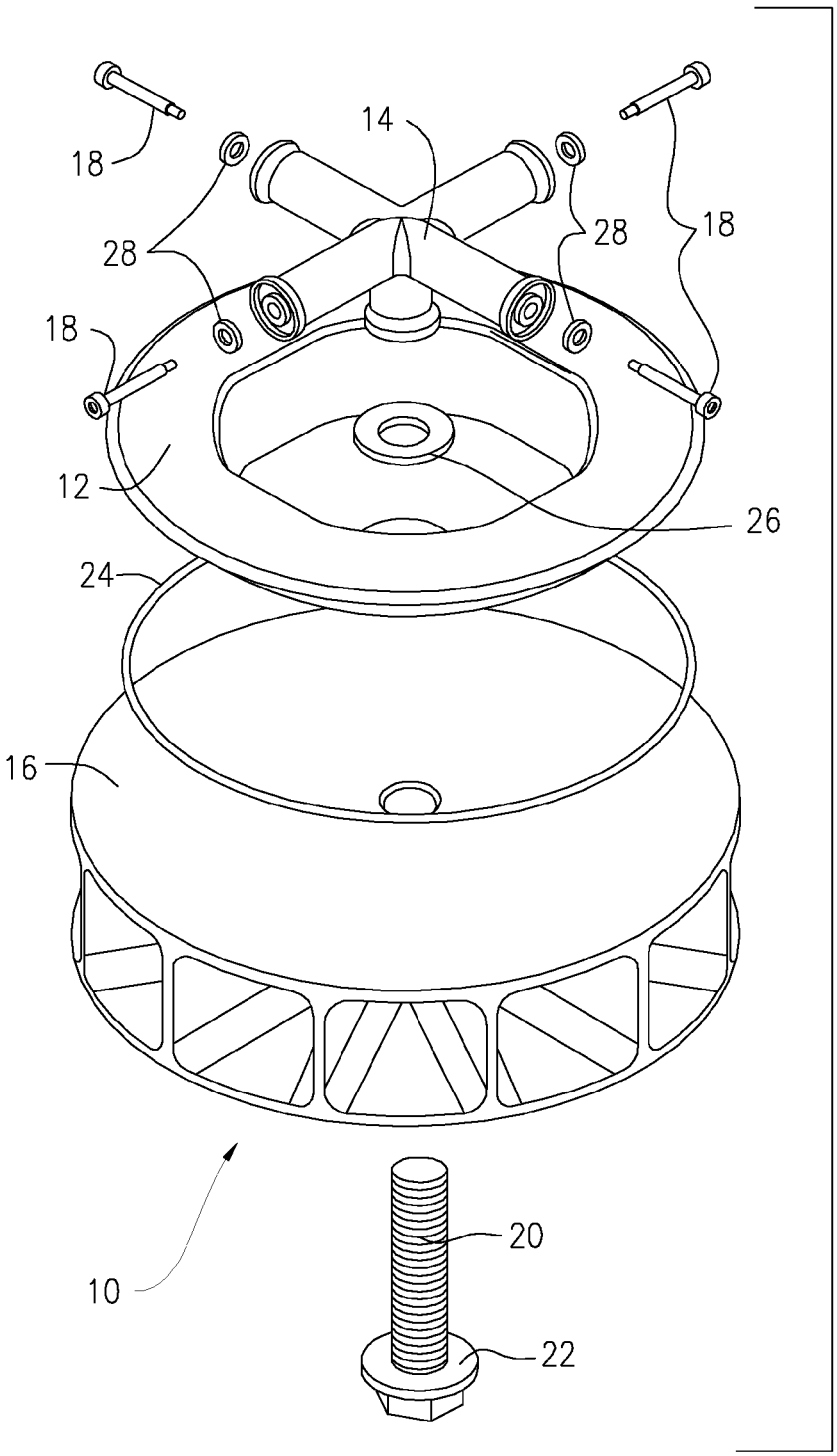
FIG. 3A is an exploded, top perspective view of the tie down assembly shown in FIG. 1A.
Figure 3B:
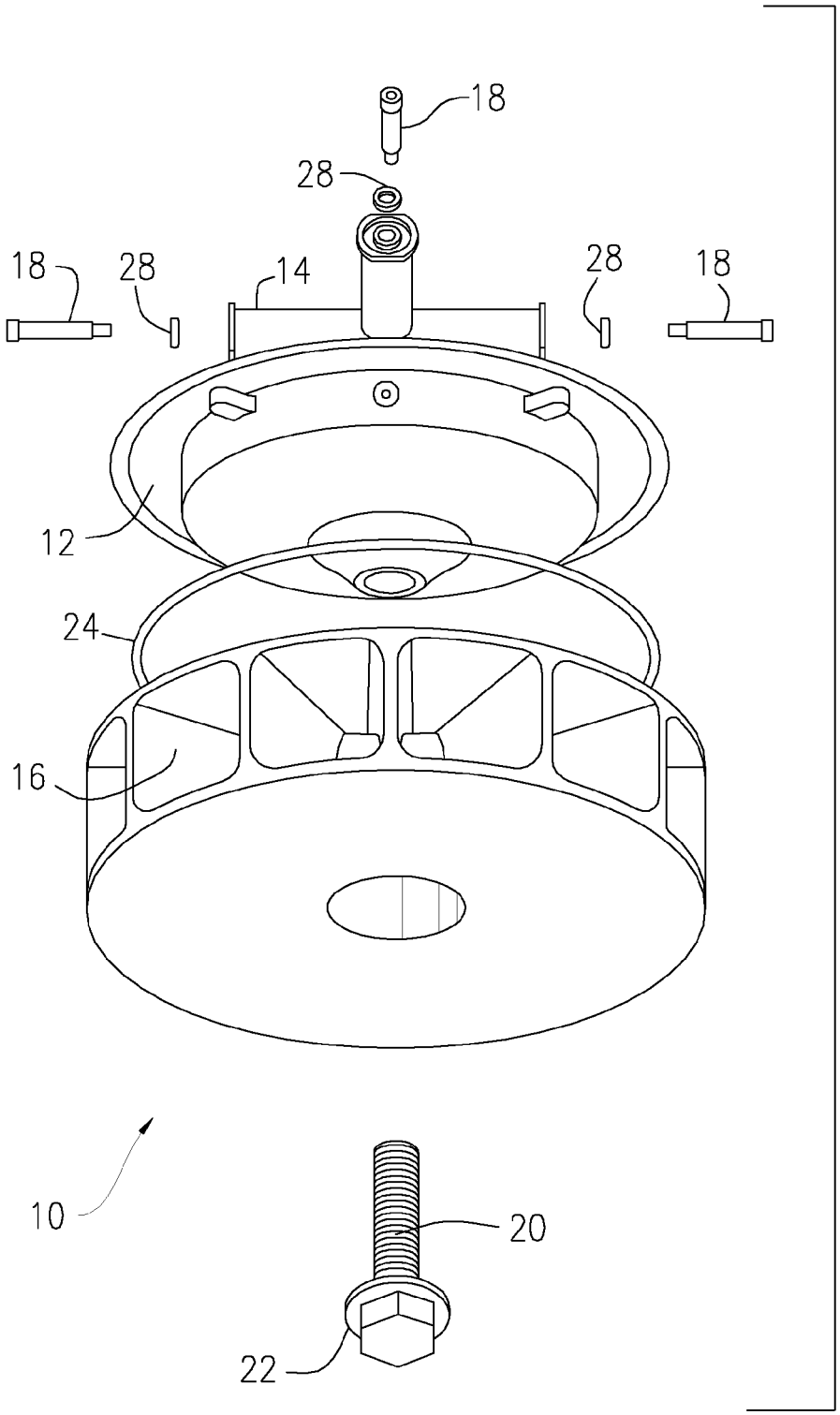
FIG. 3B is an exploded, bottom perspective view of the tie down assembly shown in FIG. 1B.

Referring to FIGS. 1A and 1B and FIGS. 2A and 2B, in an embodiment, a tie down assembly 10 includes a funnel-shaped cup 12, a cross-shaped crossbar 14 that is fastened removably to the cup 12, and a disc-shaped plate 16 that is fastened removably to the cup 12 and the crossbar 14. Referring to FIGS. 2B, 3A and 3B, in an embodiment, the crossbar 14 is fastened to the cup 12 by a plurality of threaded fasteners 18, while the plate 16 is fastened to the cup 12 and the crossbar 14 by a threaded fastener 20 having an associated washer 22. In an embodiment, the cup 12 includes an O-ring 24, whose purpose shall be described hereinafter. In an embodiment, a gasket 26 is positioned between the cup 12 and the crossbar 14 (see in particular FIG. 3A), while each of a plurality of O-rings 28 is positioned between the fasteners 18 and the crossbar 14 (see FIGS. 3A and 3B).

In an embodiment, the cup 12 and the plate 16 are each made from aluminum, and the crossbar 14 is made from steel. In other embodiments, the cup 12, the crossbar 14, and the plate 16 are made from other suitable materials known in the art, such as other types of metals or metal alloys. In an embodiment, the cup 12, the crossbar 14, and the plate 16 are produced by forging. In another embodiment, the cup 12 and the plate 16 are produced by machining. While the cup 12 is funnel-shaped, it may consist of other shapes and sizes, in accordance with other embodiments. While the crossbar 14 is cross-shaped, it may consist of other shapes and sizes, in accordance with other embodiments. While the plate 16 is disc-shaped, it may consist of other shapes and sizes, in accordance with other embodiments. The features and functions of the cup 12, the crossbar 14, and the plate 16 shall be described hereinafter.

Referring to FIGS. 4A through 4D, in an embodiment, the cup 12 includes a funnel-shaped base 30 having an outer surface 32 and an inner surface 34 that defines a circular-shaped recess 36. In an embodiment, the base 30 tapers from a top end 38 to a bottom end 40 thereof, converging at a stem 42 having a circular-shaped aperture 44. In an embodiment, the base 30 further includes a sidewall 46 and a plurality of apertures 48 formed therein that extend from the outer surface 32 to the inner surface 34. In an embodiment, the cup 12 includes four of the apertures 48, which are arranged in a cross-like pattern (i.e., positioned 90 degrees from each other). In other embodiments, the cup 12 includes more or less than four of the apertures 48.

Figure 4A:
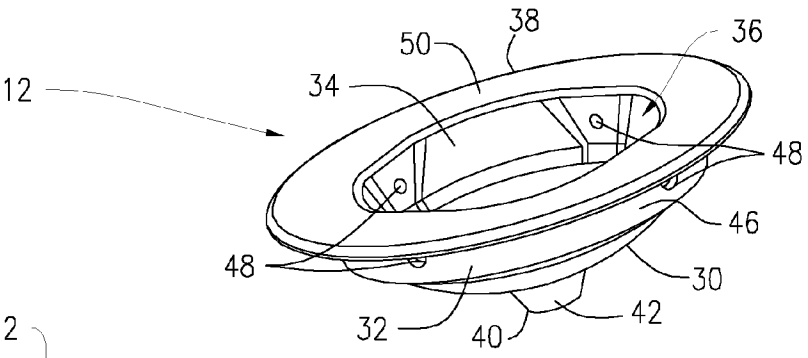
FIG. 4A is a top perspective view of a cup employed by the tie down assembly shown in FIG. 1A.
Figure 4B:
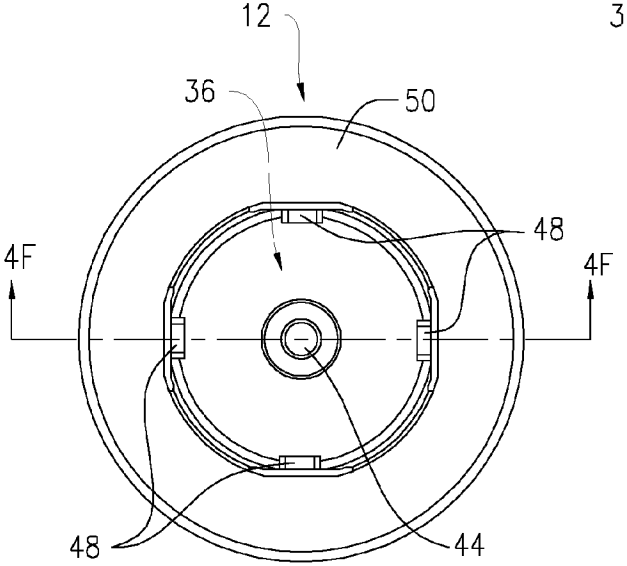
FIG. 4B is a top plan view of the cup shown in FIG. 4A.
Figure 4C:
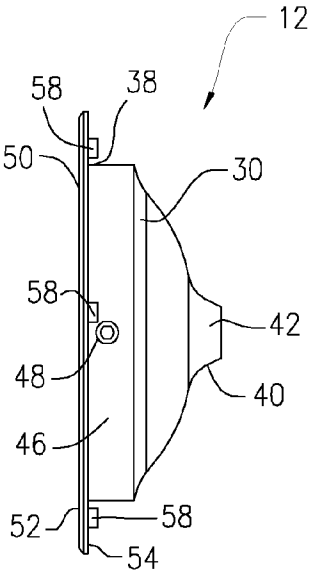
FIG. 4C is a side elevational view of the cup shown in FIG. 4A.
Figure 4E:
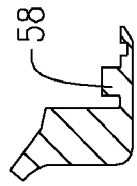
FIG. 4E is a cross-sectional view, taken along line C-C and looking in the direction of the arrows, of the cup shown in FIG. 4D.
Figure 4D:
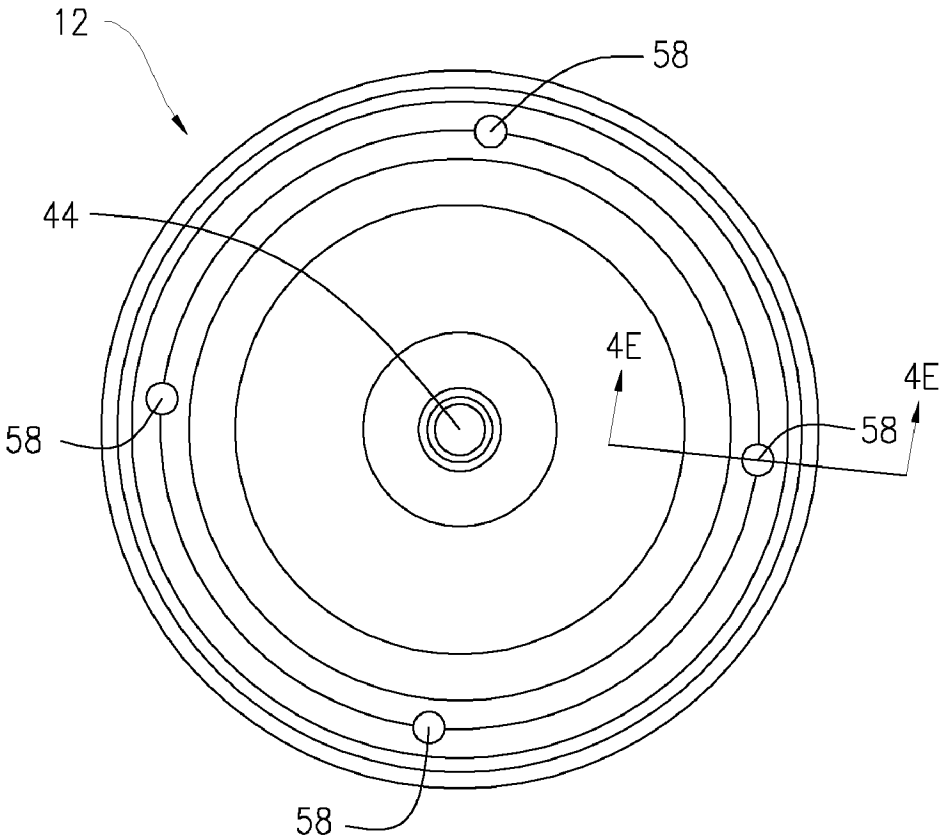
FIG. 4D is a bottom plan view of the cup shown in FIG. 4A.
Figure 4H:
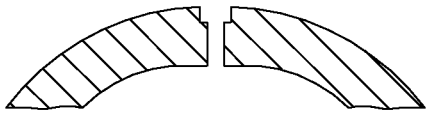
FIG. 4H is a cross-sectional view, taken along line D-D and looking in the direction of the arrows, of the cup shown in FIG. 4F.
Figure 4F:
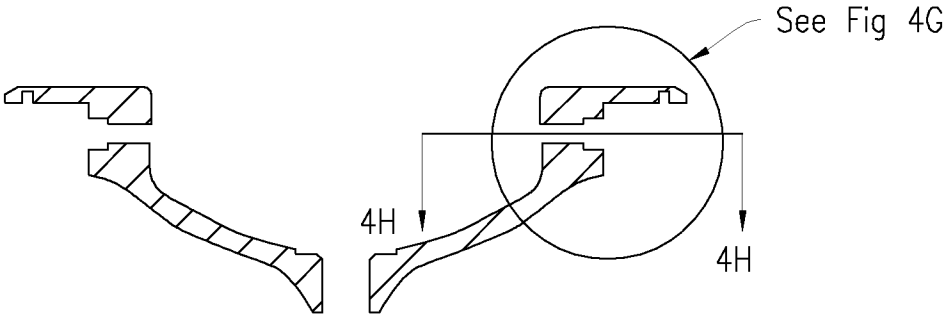
FIG. 4F is a cross-sectional view, taken along line A-A and looking in the direction of the arrows, of the cup shown in FIG. 4B.
Figure 4G:
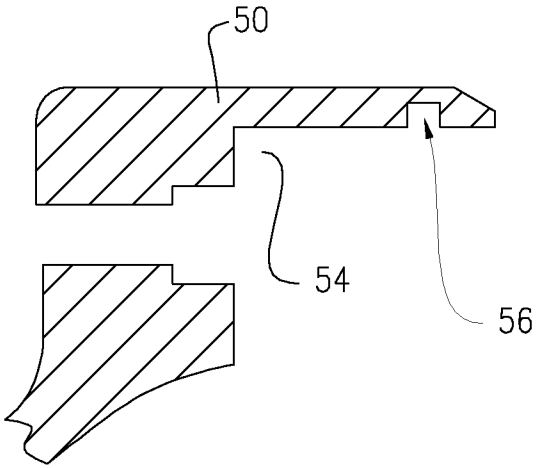
FIG. 4G is an enlarged view of Detail B of the cup shown in FIG. 4F.
Figure 5B:
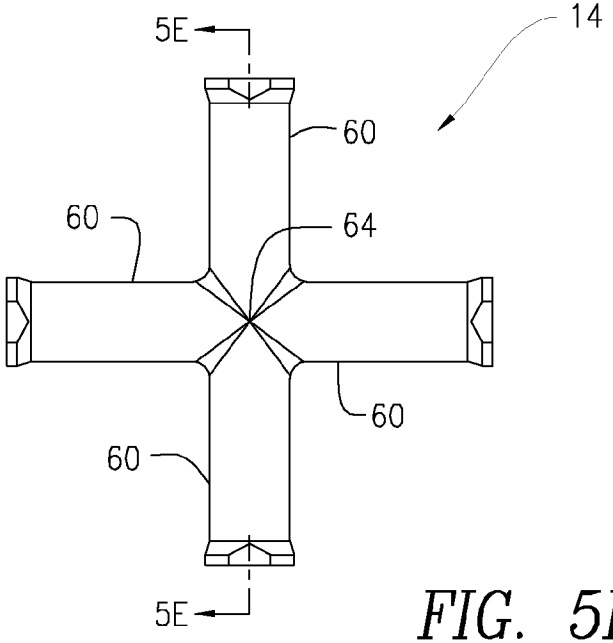
FIG. 5B is a top plan view of the crossbar shown in FIG. 5A.
Figure 5A:
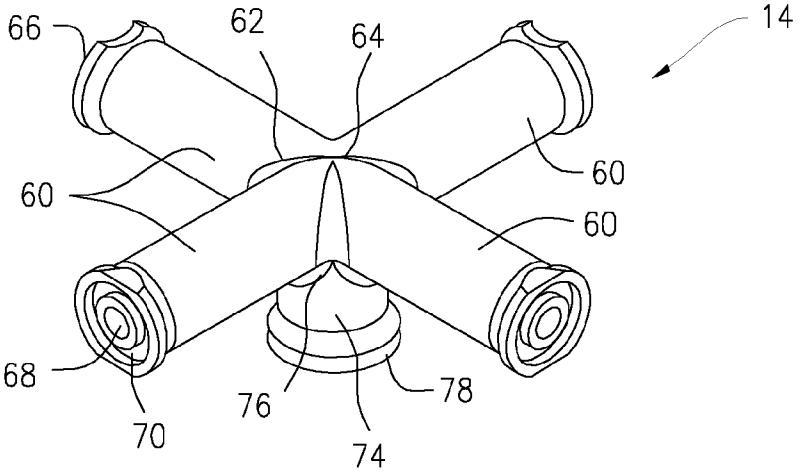
FIG. 5A is a top perspective view of a crossbar employed by the tie down assembly shown in FIG. 1A.
Figure 5F:
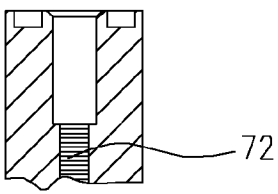
FIG. 5F is an enlarged view of Detail B of the crossbar shown in FIG. 5E.
Figure 5E:
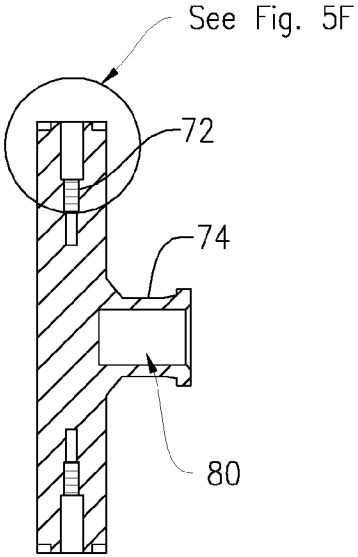
FIG. 5E is a cross-sectional view, taken along line A-A and looking in the direction of the arrows, of the crossbar shown in FIG. 5B.
Figure 5C:
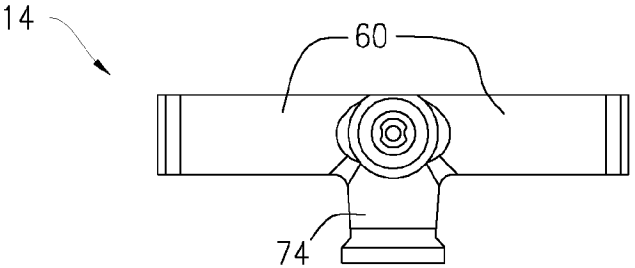
FIG. 5C is a side elevational view of the crossbar shown in FIG. 5A.
Figure 5D:
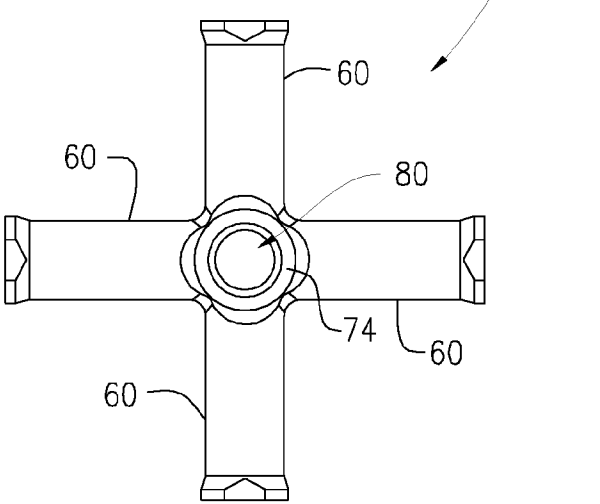
FIG. 5D is bottom plan view of the crossbar shown in FIG. 5A.

Still referring to FIGS. 4A through 4D, in an embodiment, the cup 12 includes a circular-shaped flange 50 that surrounds the perimeter of the recess 36. In an embodiment, the flange 50 includes a top surface 52 and a bottom surface 54 opposite thereof. In an embodiment, a circular-shaped groove 56 is formed within the bottom surface 54 of the flange 50 (see specifically FIG. 4G) for receiving the O-ring 24. In an embodiment, a plurality of tabs 58 extend outwardly from the sidewall 46 and are positioned directly below the bottom surface 54 of the flange 50, as shown best in FIGS. 4C through 4E. In an embodiment, the cup 12 includes four of the tabs 58, which are arranged in a cross-like pattern (i.e., 90 degrees from each other). In other embodiments, the cup 12 includes more or less than four of the tabs 58. In an embodiment, each of the tabs 58 is circular in shape (see FIGS. 4C and 4D). In another embodiment, each of the tabs 58 has an oblong shape (see FIGS. 1B and 3B). In other embodiments, each of the tabs 58 consist of other shapes and sizes, e.g., square, rectangular, etc. FIGS. 4E through 4G illustrate additional cross-sectional views of the cup 12.

Referring to FIGS. 5A through 5F, in an embodiment, the crossbar 14 includes a plurality of tubular-shaped members 60, each of which has a first end 62 that intersects with the other ends 62 at a central point 64, and a free end 66. In an embodiment, each of the members 60 lie within the same plane. In an embodiment, each of the members 60 includes a centrally located, circular-shaped aperture 68 formed within the free end 66 thereof, and a circular-shaped groove 70 that surrounds the aperture 68. In an embodiment, each of the apertures 68 includes internal threads 72 (see FIGS. 5E and 5F) that threadedly engage a corresponding one of the fasteners 18. The crossbar 14 further includes a tubular-shaped stem 74 that extends perpendicularly from the members 60 at the central point 64. In an embodiment, the stem 74 has a first end 76 connected to the central point 64 and a free end 78 having a centrally located, circular-shaped aperture 80 (see FIG. 5D). In an embodiment, the aperture 80 includes internal threads (not shown in the Figures) that threadedly engage the fastener 20.

Figure 6A:
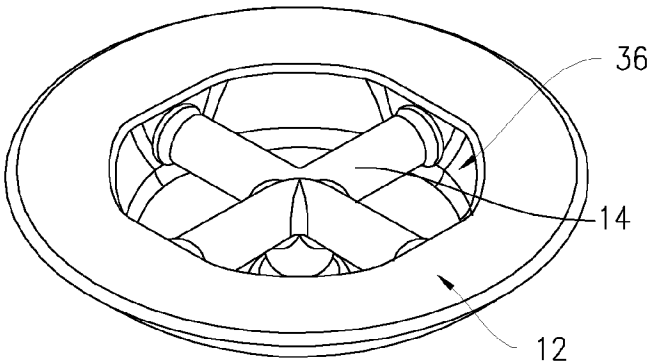
FIG. 6A is a top perspective view of the cup shown in FIG. 4A and the crossbar shown in FIG. 5A mounted to one another.
Figure 6C:
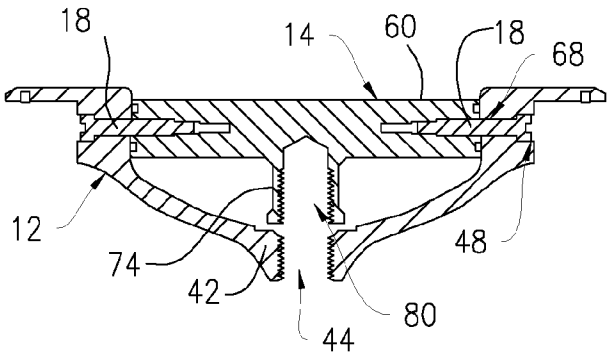
FIG. 6C is a cross-sectional view, taken along line A-A and looking in the direction of the arrows, of the cup-crossbar assembly shown in FIG. 6B.
Figure 6B:
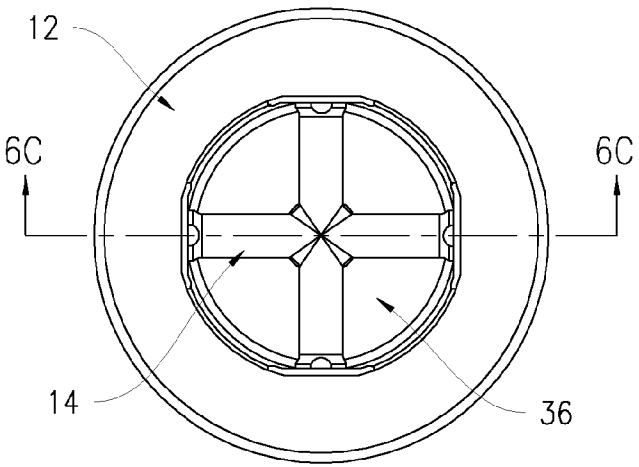
FIG. 6B is a top plan view of the cup-crossbar assembly shown in FIG. 6A.
Figure 7B:
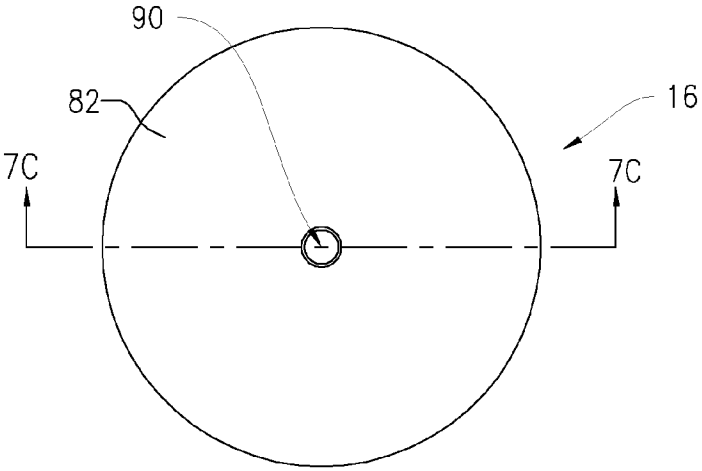
FIG. 7B is a top plan view of the plate shown in FIG. 7A.
Figure 7D:
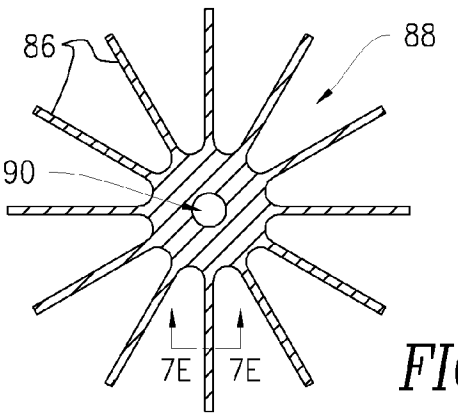
FIG. 7D is a cross-sectional view, taken along line B-B and looking in the direction of the arrows, of the plate shown in FIG. 7C.
Figure 7E:
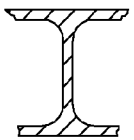
FIG. 7E is a cross-sectional view, taken along line C-C and looking in the direction of the arrows, of the plate shown in FIG. 7D.
Figure 7A:
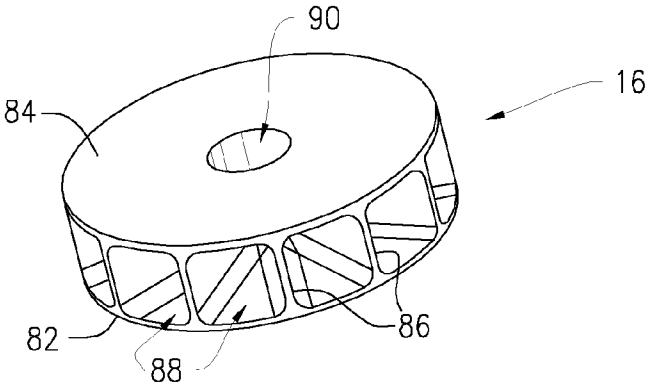
FIG. 7A is a bottom perspective view of a plate employed by the tie down assembly shown in FIG. 1A.
Figure 7C:
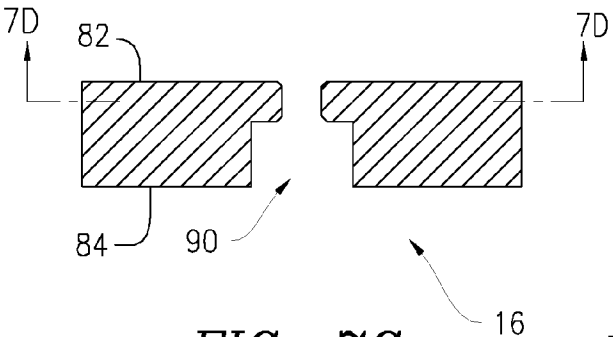
FIG. 7C is a cross-sectional view, taken along line A-A and looking in the direction of the arrows, of the plate shown in FIG. 7B.

In an embodiment, FIGS. 6A through 6C show the crossbar 14 fastened to the cup 12 by the fasteners 18. In this regard, the crossbar 14 is positioned within the recess 36 of the cup 12, such that one of the apertures 68 of one of the members 60 aligns with a corresponding one of the apertures 48 of the cup 12. In addition, the stem 74 of the crossbar 14 is aligned with the stem 42 of the cup 12, such that the aperture 80 of the stem 74 aligns with the aperture 44 of the cup 12 (see FIG. 6C). In an embodiment, the gasket 26 is positioned at the free end 78 of the stem 74, while each of the O-rings 28 is positioned within a corresponding one of the grooves 70 of one of the members 60 (not shown in FIGS. 6A through 6C, but see FIG. 3A). In an embodiment, each of the fasteners 18 are inserted into a corresponding one of the apertures 48 of the cup 12 and, in turn, threadedly engage a corresponding one of the apertures 68 of the one of the members 60, thereby securing the crossbar 14 to the cup 12. In another embodiment, the apertures 68 of the members 60 are filled with a sealant when the fasteners 18 are installed to provide a seal. In an embodiment, the fasteners 18, 20 are threaded bolts.

Referring to FIGS. 7A through 7E, in an embodiment, the plate 16 includes a circular-shaped first surface 82 and a circular-shaped second surface 84 opposite thereof, which are separated by a plurality of ribs 86 that form a plurality of gaps 88. In an embodiment, each of the first and second surfaces 82, 84 of the plate 16 consists of other shapes and sizes, such as square, elliptical, polygonal. In an embodiment, the ribs 86 provide for strength and stiffness of the plate 16, and the gaps 88 result a reduction of mass and weight in the plate 16. In an embodiment, the plate 16 includes a centrally located, circular-shaped counterbore 90 that extends from the first surface 82 to the second surface 84. In an embodiment, the diameter of the counterbore 90 at the second surface 84 is greater than the diameter of the counterbore 90 at the first surface 82. In an embodiment, the fastener 20 is inserted into the counterbore 90 of the plate 16 from the second surface 84 and to the first surface 82, and threadedly engages the aperture 80 of the stem 74 of the crossbar 14.

Figure 8:
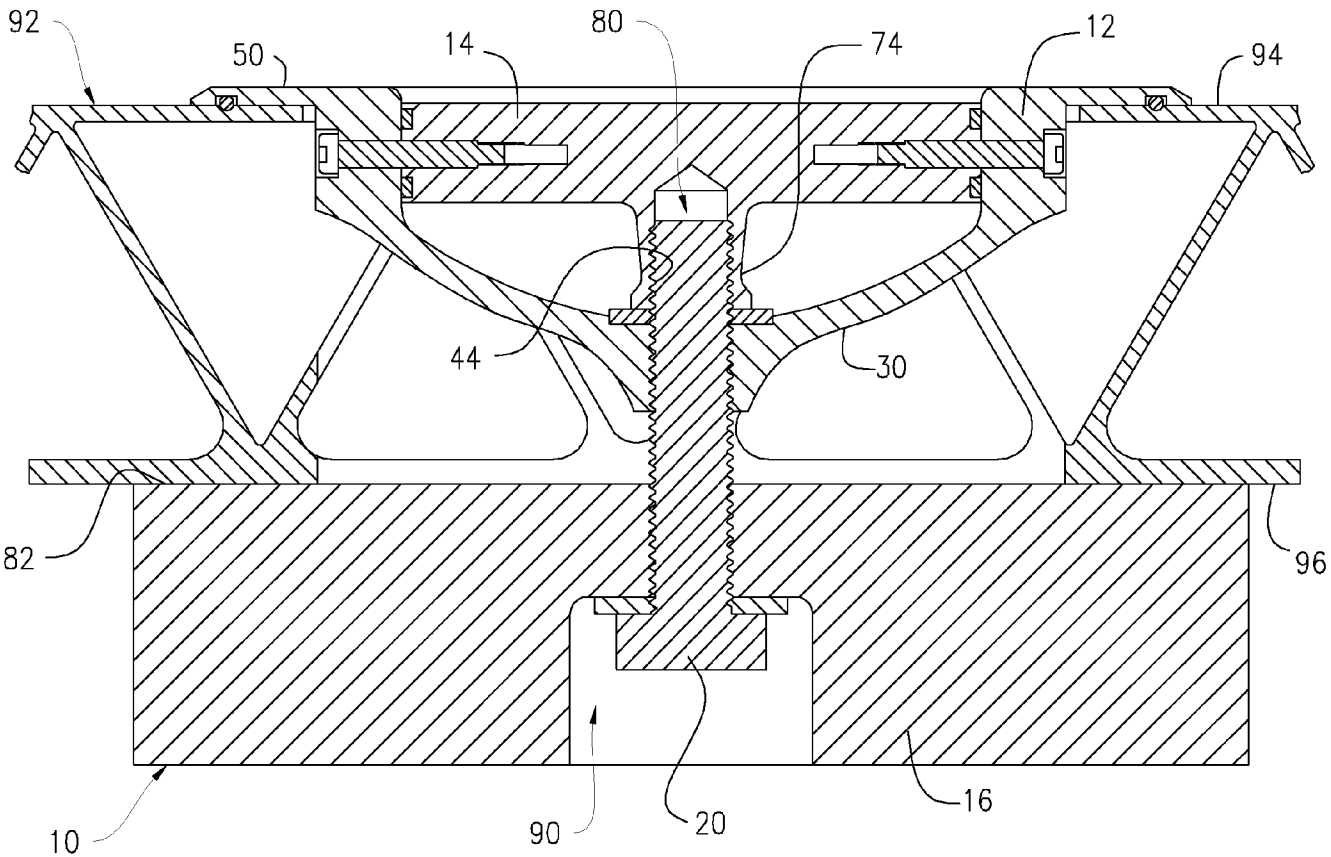
FIG. 8 is a cross-sectional view of the tie down assembly shown in FIG. 2B mounted to a deck of a vessel.
Figure 9A:
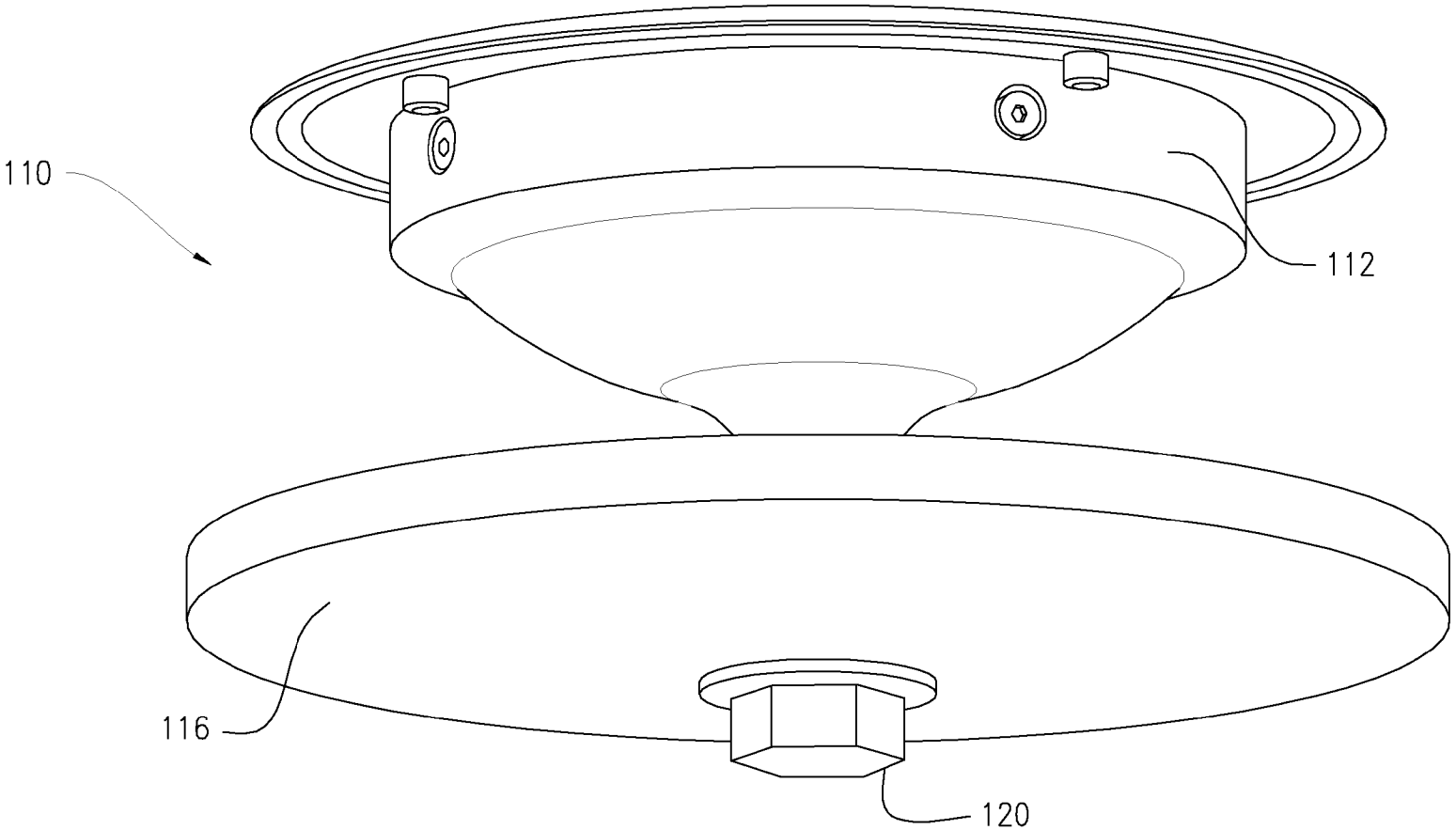
FIGS. 9A through 9D illustrate a tie down assembly in accordance with another embodiment of the present invention.
Figure 9B:
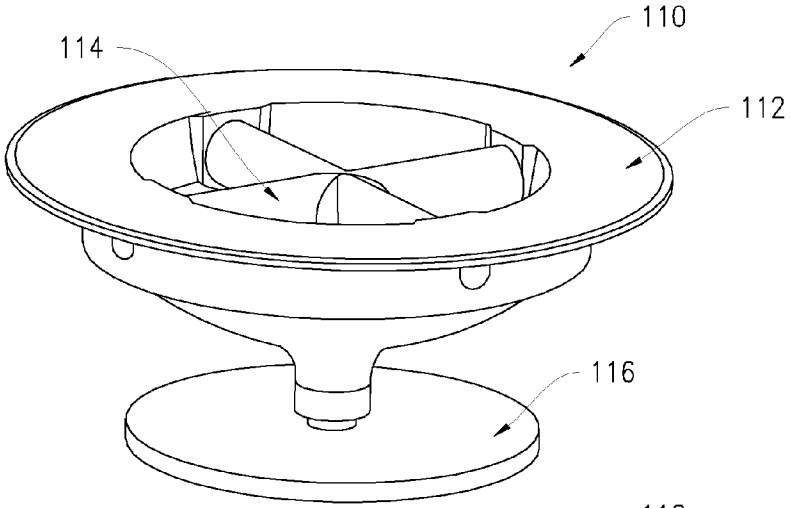
Figure 9C:
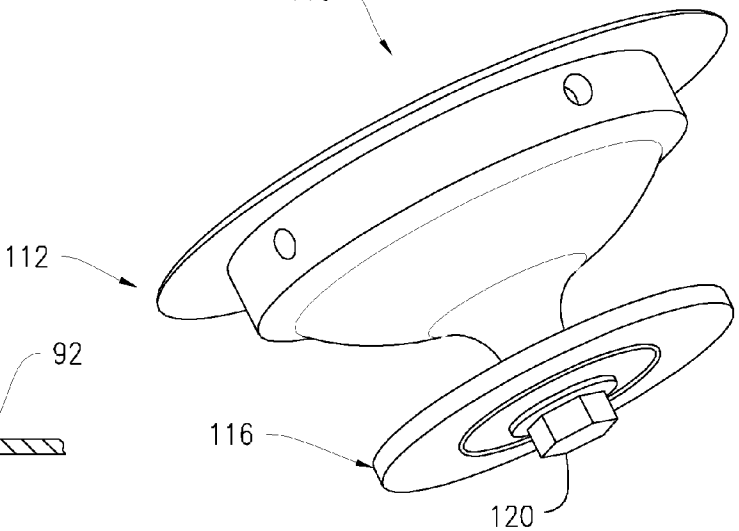
Figure 9D:
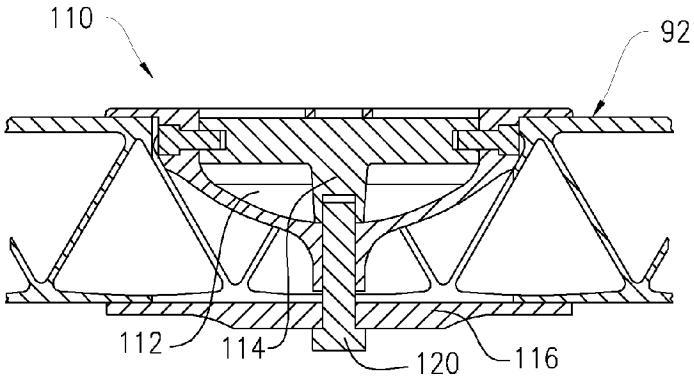

Referring to FIG. 8, in an embodiment, the tie down assembly 10 is installed in a deck 92 of a vessel having an upper layer 94 and a lower layer 96. In an embodiment, the deck 92 is made from aluminum. In other embodiments, the deck 92 is made from other materials, such as metals and metal alloys. In an embodiment, the deck 92 includes a solid portion(s). In another embodiment, the deck 92 is corrugated. In another embodiment, the deck 92 is a multi-hollow extrusion. In another embodiment, the deck 92 is characterized by a fabricated, complex geometrical decking structure. In an embodiment, a hole is bored into the upper and lower layers 94, 96 of the deck 92 (not shown in the Figures). In an embodiment, the diameter of the hole is substantially equal to the diameter of the base 30 of the cup 12. In an embodiment, additional holes, which are smaller in size than that of the aforesaid hole, are bored into the upper layer 94 of the deck 92, and are sized and shaped and arranged to accommodate the receipt of the tabs 58 of the cup 12 (not shown in the Figures). The crossbar 14 is secured to the cup 12 as described above, and the base 30 of the cup 12 is positioned within the aforesaid larger hole, while the tabs 58 are positioned within the aforesaid smaller holes (not shown in the Figures). As a result, the flange 50 of the cup 12 rests on the top surface of the upper layer 94 of the deck 92 and lies flush, leaving the crossbar 14 exposed within the upper layer 94.

In an embodiment, the plate 16 is positioned beneath the lower layer 96 of the deck 92, whereby the first surface 82 of the plate 16 is juxtaposed with the lower layer 96. In an embodiment, the fastener 20 is inserted within the counterbore 90 of the plate 20 and, in turn, the aperture 44 of the cup 12 and threadedly engages the aperture 80 of the stem 74 of the crossbar 14. In an embodiment, as the fastener 20 is tightened, a compressive load is introduced and forces the upper and lower layers 94, 96 of the deck 92 together. In an embodiment, the tie down assembly 10 is preloaded when installed, resulting in no gaps between the flange 50 of the cup 12 and the upper layer 94 of the deck 92, and between the plate 16 and the lower layer 96 of the deck 92. That is, the fastener 20 is preloaded to a predetermined torque rating to produce a preloaded compressive assembly, thereby maintaining the assembly 10 within the deck 92 during use. In an embodiment, the fastener 20 is preloaded to a torque rating in the range of approximately 150 ft.-lbs. to approximately 250 ft.-lbs. In an embodiment, the fastener 20 is preloaded to a torque rating of approximately 190 ft.-lbs. In an embodiment, all of the preload is borne through the fastener 20 in the span between the cup 12 and the washer 22. Above this span, in an embodiment, the load splits, with approximately half of the load going up into the crossbar 14 then out to the flange 50 of the cup 12 and into the deck 92, while approximately the other half of the load goes through the base 30 of the cup 12 then out to the flange 50 and into the deck 92.

In an embodiment, a seal is formed between the tie down assembly 10 and the deck 92, which prevents corrosion from foreign substances, such as seawater. In an embodiment, the flange 50 of the cup 12 lies substantially flush with the upper layer 94 of the deck 92, minimizing the protrusion of the assembly 10 above the deck 92. In an embodiment, the tabs 58 of the cup 12 prevent rotation of the tie down assembly 10 relative to the deck 92, thereby maintaining the stability of the assembly 10 during use.

In an embodiment, the crossbar 14 is sized and shaped to accommodate the receipt of various tie down connectors, such as hooks, clips, cables, rope, etc. (not shown in the Figures). In an embodiment, the load endured by the tie down assembly 10 is borne by the fastener 20 as described above, and shear is borne by the fasteners 18.

In an embodiment, in the event the tie down assembly 10 requires repair or replacement, it is removed from the deck 92 by unfastening the fastener 20 from the crossbar 14 and the cup 12. As a result, the cup 12 and crossbar 14 assembly can be lifted out of the hole in the upper layer 94 of the deck 92.

In an embodiment, the cup 12 and the plate 16 are made from aluminum, while the crossbar 14 is made from steel, resulting in a savings in weight of approximately 50% as a compared to if the cup 12, the crossbar 14, and the plate 16 were each made from steel.

In an embodiment, the crossbar 14 is coated with a coating for preventing wear from where aforesaid connectors engage the crossbar 14. In an embodiment, the coating composition consists of an aluminum/stainless steel blend manufactured by Alcoa, Inc., and which is the subject of U.S. Pat. Nos. 5,884,388 and 6,290,032, which are incorporated herein by reference herein in their entireties. In other embodiments, the coating includes an electroless nickel phosphorous coating, such as NIBORE™ brand of coating, a diamond chrome coating, a hard chrome coating, or a nickel cobalt coating, all of which are supplied by Bales Mold Service Inc. of Downers Grove, Ill. In other embodiments, the coating includes a wear-resistant cubic boron nitride, hard powder coating, such as TUFFTEK® brand of coating supplied by NanoMech, LLC d/b/a Duralor of Springdale, Ark. In other embodiments, other suitable coatings that prevent wear and are known in the art may be utilized.

Pull tests on the tie down assembly 10 were performed using strain gauged test hooks on the crossbar 14, and a load of 32,000 pounds was met. Visual inspection of the tie down assembly 10 was performed and no yielding of material was evident. Further visual inspection was performed on the fasteners 18 and 20, which revealed no evidence of yielding. In addition, tie down leak testing was performed to verify that the gasket 26 and the O-rings 24 and 28 did not leak. In this regard, a no pull-leak test was performed by filling the cup 12 with water and subsequently inspected. The results revealed no leakage. Also, a 32,000 pound pull-leak test was performed by submerging the tie down assembly 10 in water. Testing was conducted for 10 minutes and no leaks were detected. This was followed by rotating the tie down assembly 10 ninety (90) degrees and testing for 15 minutes, resulting in no leakage.

FIGS. 9A through 9D illustrate another embodiment of the present invention, in which a tie down assembly 110 includes a cup 112, a crossbar 114, and a plate 116 that is secured to the cup 112 and the crossbar 114 by a fastener 120. In an embodiment, the tie down assembly 110 has a structure and function that are similar to the tie down assembly 10, except that the former includes a solid disc-shaped plate 116 having no ribs or gaps. The tie down assembly 110 is installed within the deck 92 in a manner similar to that described above with respect to the tie down assembly 10 (see FIG. 9D).

Figure 10B:
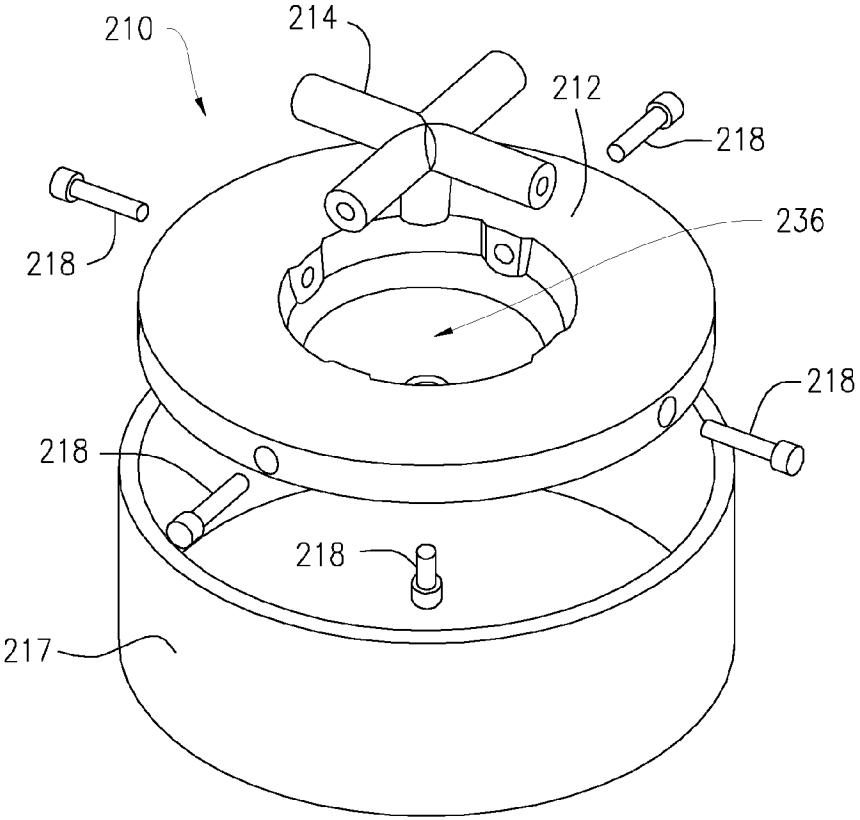
FIGS. 10A through 10B illustrate a tie down assembly in accordance with another embodiment of the present invention.
Figure 10A:
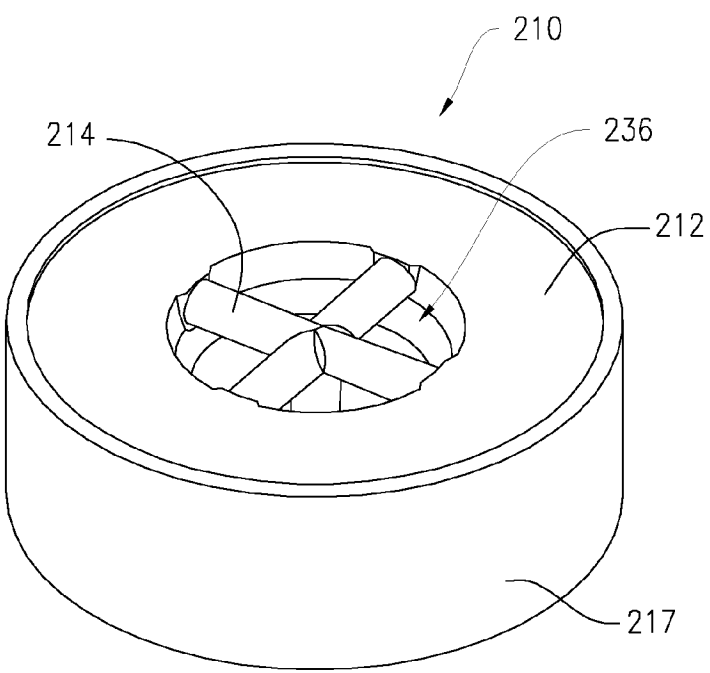

FIGS. 10A and 10B illustrate another embodiment of the present invention, in which a tie down assembly 210 includes a cup 212, a crossbar 214 mounted within a recess 236 of the cup 212 by a plurality of fasteners 218, and a tubular-shaped sleeve 217. In an embodiment, the cup 212 and the sleeve 217 are made from aluminum, while the crossbar 214 and the fasteners 218 are made from stainless steel. In an embodiment, the cup 212 is welded to one end of the sleeve 217 by welding means known in the art (e.g., MIG, etc.). In an embodiment, a bottom cap (not shown in the Figures) is welded to another end of the sleeve. In an embodiment, the tie down assembly 210 is welded to an aluminum deck (not shown in the Figures).

Figure 11B:
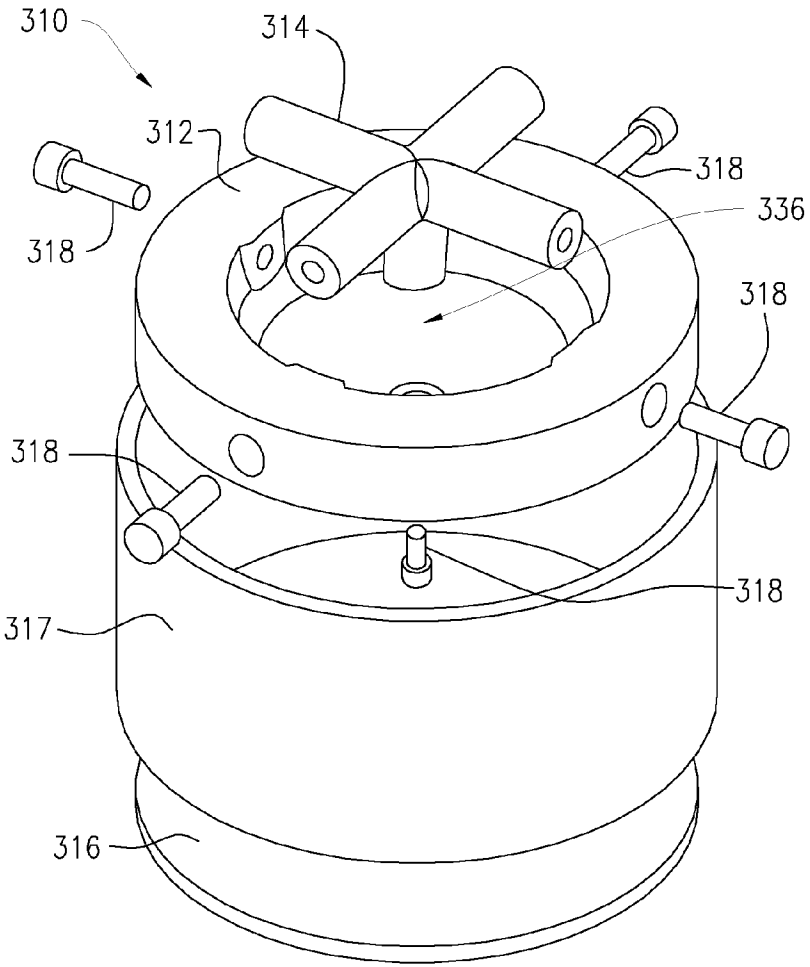
FIGS. 11A through 11B illustrate a tie down assembly in accordance with another embodiment of the present invention.
Figure 11A:
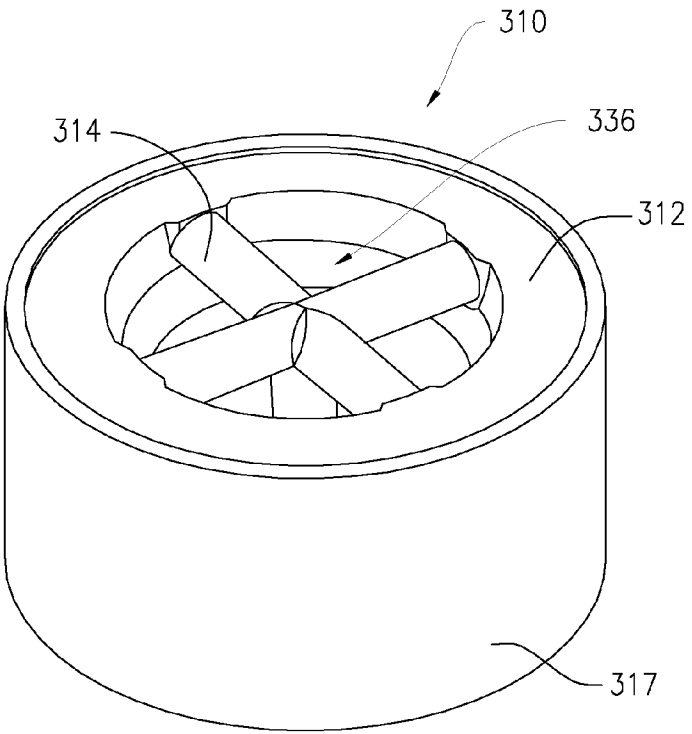

FIGS. 11A and 11B illustrate another embodiment of the present invention, in which a tie down assembly 310 a cup 312, a crossbar 314 mounted within a recess 336 of the cup 312 by a plurality of fasteners 318, a tubular-shaped sleeve 317, and a bottom plate 316 attached to the sleeve 317. In an embodiment, the tie down assembly 310 is identical to the tie down assembly 210, except that the recess 336 of the cup 312 has a greater diameter and volume in order to accommodate a larger sized crossbar 314.

Figure 12B:
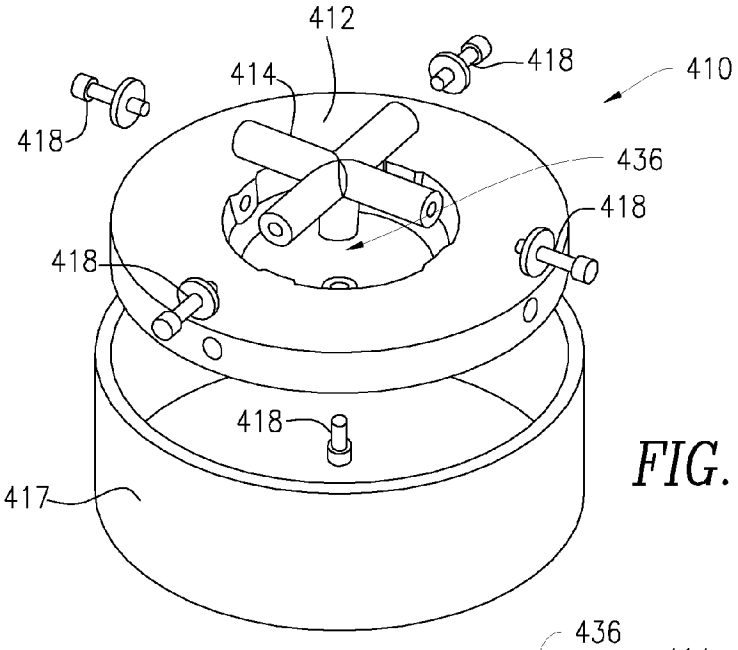
FIGS. 12A through 12D illustrate a tie down assembly in accordance with another embodiment of the present invention.
Figure 12D:
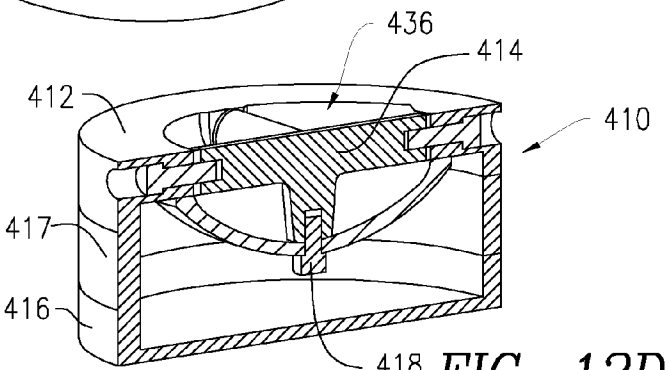
Figure 12A:
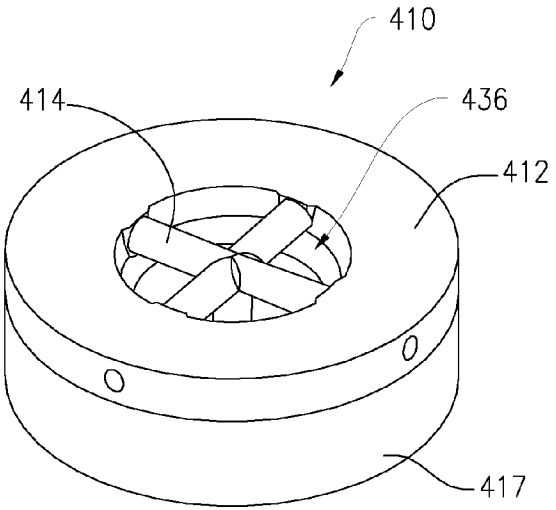
Figure 12C:
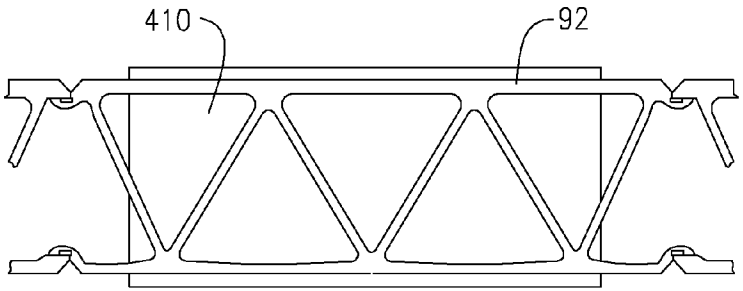

FIGS. 12A and 12B illustrate another embodiment of the present invention, in which a tie down assembly 410 includes a cup 412, a crossbar 414 mounted within a recess 436 of the cup 412 by a plurality of fasteners 418, a tubular-shaped sleeve 417, and a bottom cap 416. In an embodiment, the cup 412, the sleeve 417, and the cap 416 are made from aluminum, while the crossbar 414 and the fasteners 418 are made from stainless steel. In an embodiment, the cup 412 is welded to one end of the sleeve 417 and the cap 416 is welded to another end of the sleeve 417 by welding means known in the art (e.g., friction welding, etc.). In an embodiment, the tie down assembly 410 is welded to an aluminum deck 92.

Figure 13C:
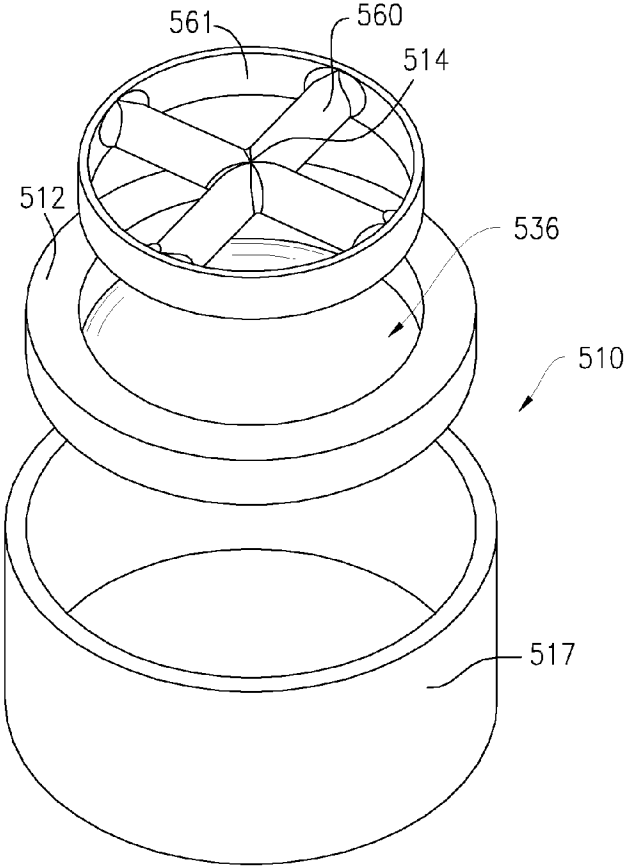
FIGS. 13A through 13C illustrate a tie down assembly in accordance with another embodiment of the present invention.
Figure 13A:
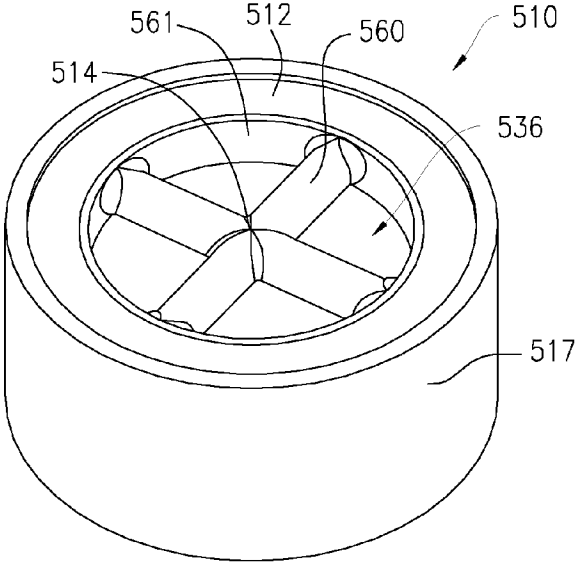
Figure 13B:
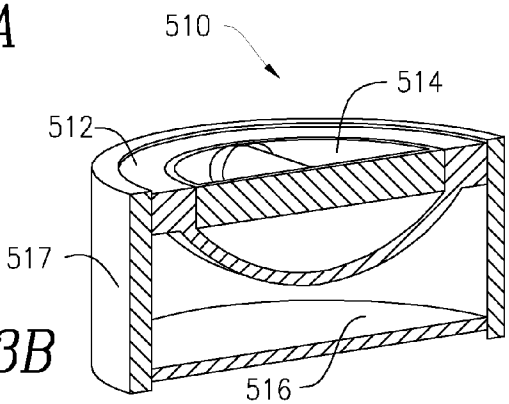

FIGS. 13A and 13C illustrate another embodiment of the present invention, in which a tie down assembly 510 includes a cup 512, a crossbar 514 mounted within a recess 536 of the cup 512, a tubular-shaped sleeve 517, and a bottom cap 516. The crossbar 514 includes a plurality of members 560 and a ring 561 that surrounds the members 560. In an embodiment, the cup 512, the sleeve 517, and the cap 516 are made from aluminum, while the crossbar 514 is made from steel. The crossbar 514 is positioned with the recess 536 of the cup 512 and attached thereto by any attachment means known in the art (e.g., friction stir welding, adhesives). In an embodiment, the crossbar 514 and the cup 512 are attached to one another by mechanical means, such as keying. In an embodiment, the cup 512 and the cap 516 are welded to the sleeve 517. In an embodiment, the tie down assembly 510 is welded to an aluminum deck (not shown in the Figures).

Figure 14C:
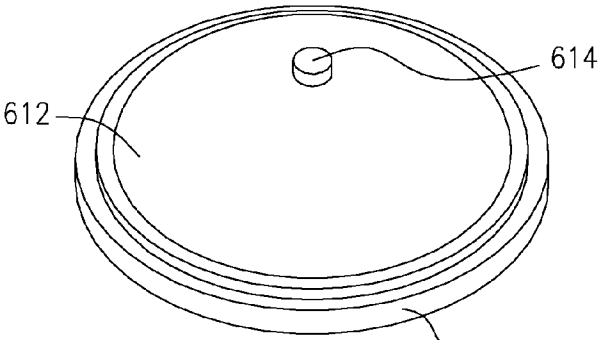
FIGS. 14A through 14D illustrate a tie down assembly in accordance with another embodiment of the present invention.
Figure 14D:
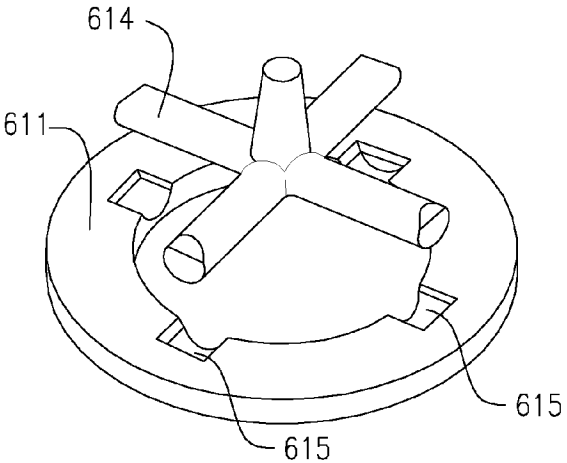
Figure 14A:
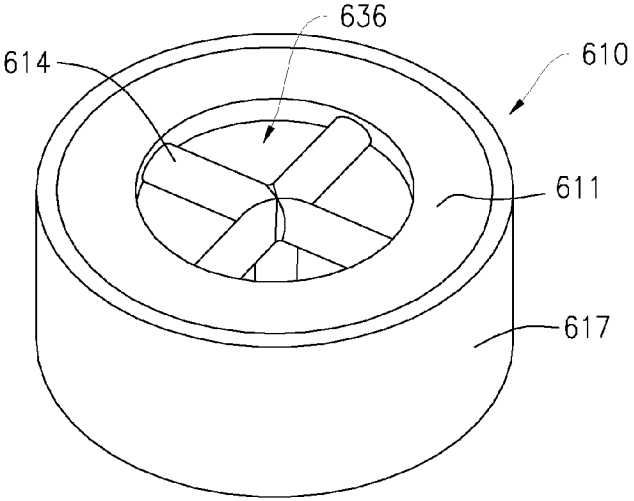
Figure 14B:
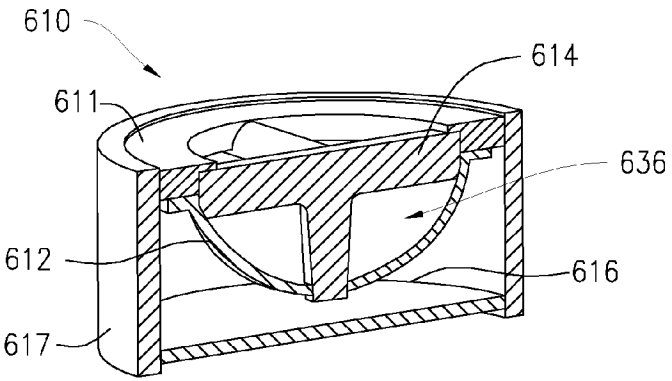
Figure 15C:
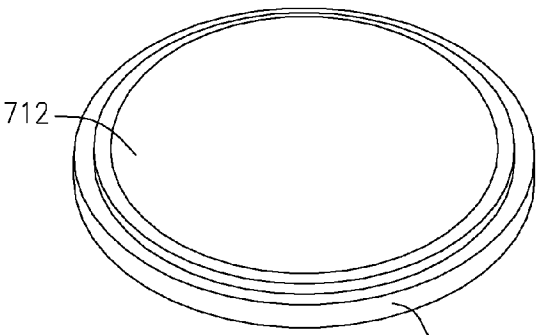
FIGS. 15A-15D illustrate a tie down assembly in accordance with another embodiment of the present invention.
Figure 15D:
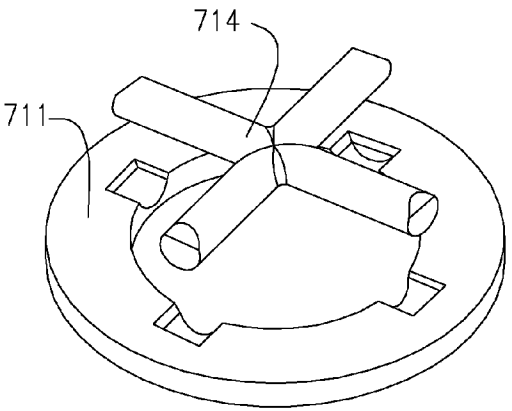
Figure 15A:
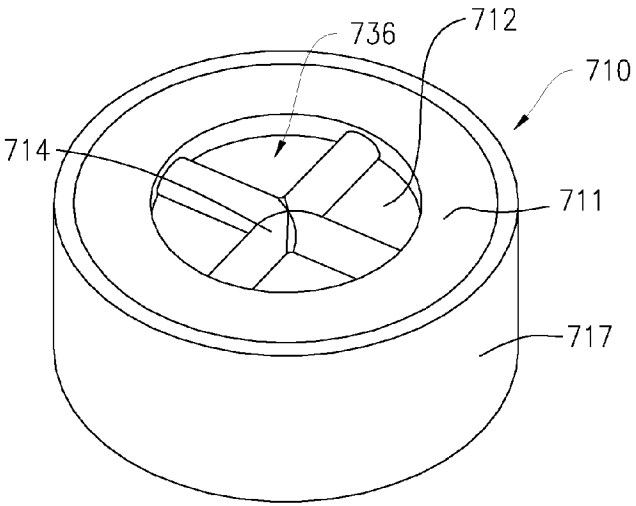
Figure 15B:
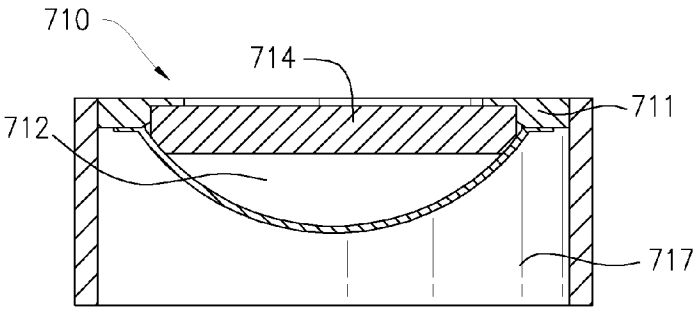
Figure 16B:
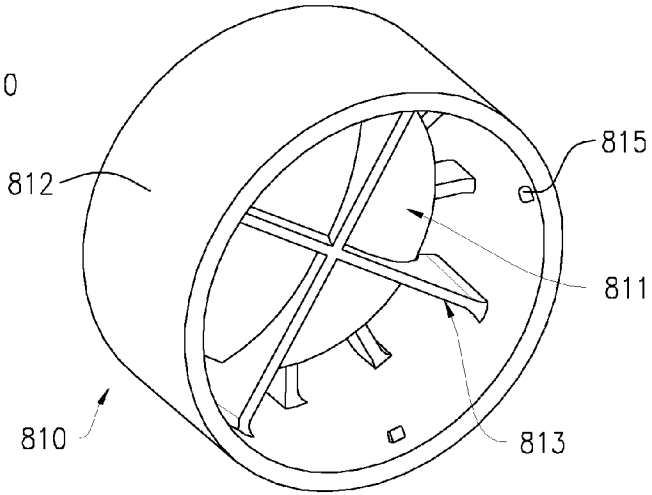
FIGS. 16A through 16D illustrate a tie down assembly in accordance with another embodiment of the present invention.
Figure 16D:
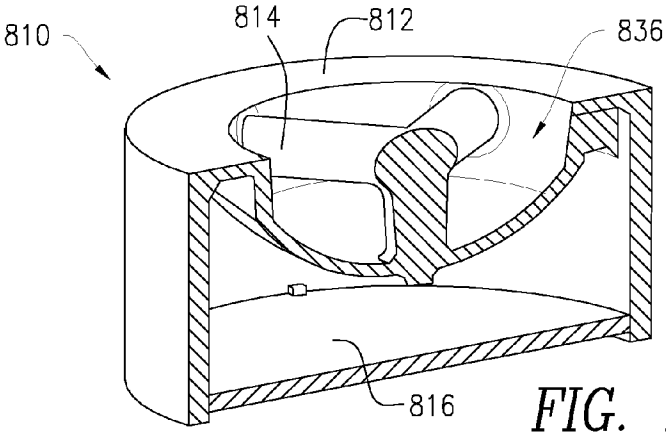
Figure 16A:
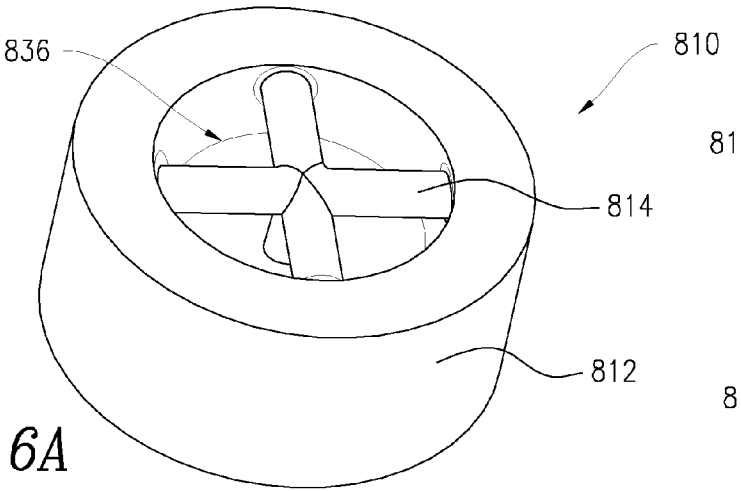
Figure 16C:
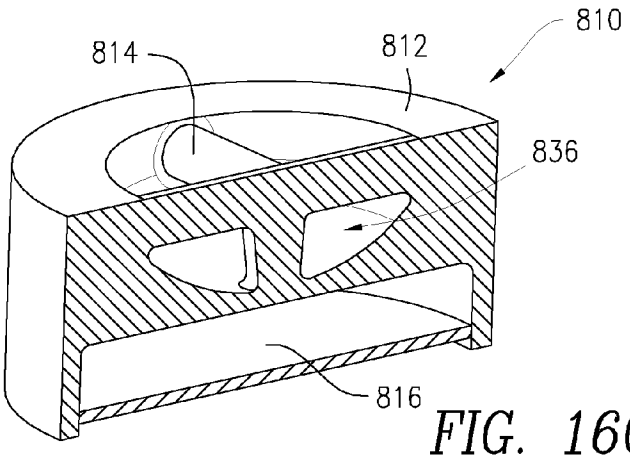
Figure 17B:
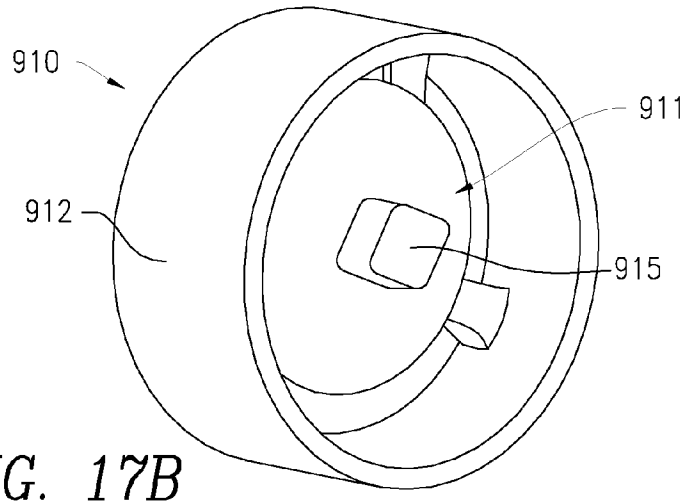
FIGS. 17A through 17D illustrate a tie down assembly in accordance with another embodiment of the present invention.
Figure 17D:
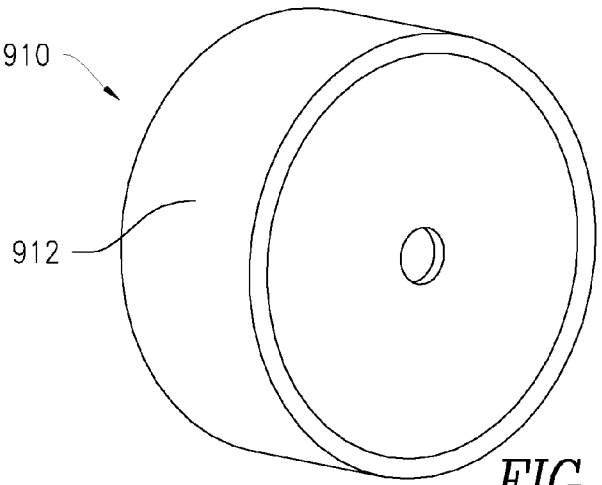
Figure 17A:
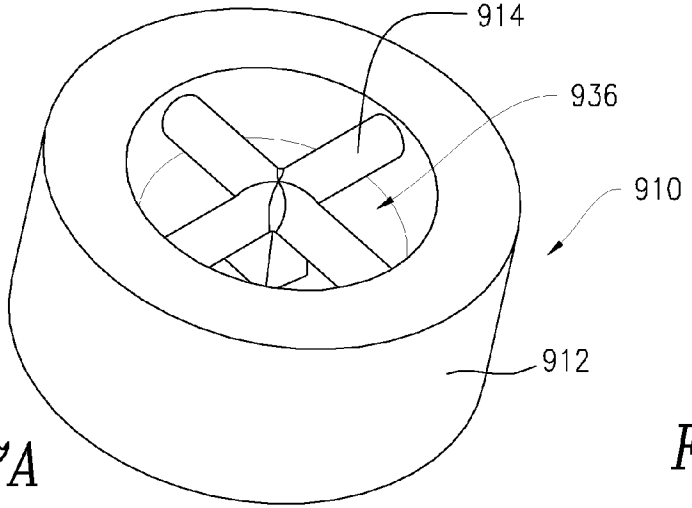
Figure 17C:
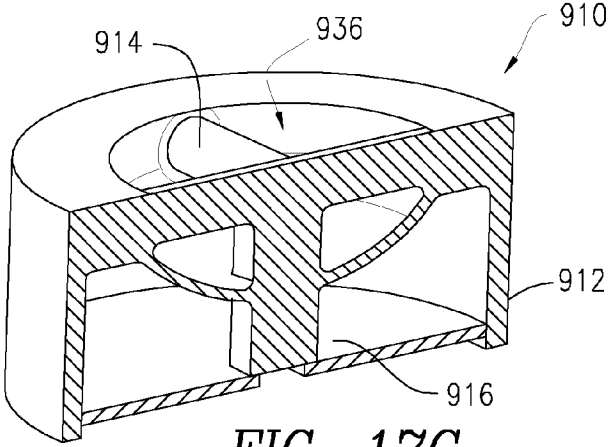

FIGS. 14A through 14C illustrate another embodiment of the present invention, in which a tie down assembly 610 includes a ring-shaped collar 611, a crossbar 614 attached to the collar 611, a funnel-shaped cover 612 having a recess 636, a sleeve 617, and a cap 616. In an embodiment, the collar 611, the crossbar 614, the cover 612, the sleeve 617, and the cap 616 are made from aluminum. In an embodiment, the crossbar 614 is welded within slots 615 formed within a bottom surface of the collar 611, and the cover 612 envelopes the crossbar 614, which is positioned within the recess 636, and is welded to the bottom surface of the collar 611. In an embodiment, the collar 611 and the cap 616 are welded to the sleeve 617. In an embodiment, the tie down assembly 610 is welded to an aluminum deck (not shown in the Figures).

FIGS. 15A through 15D illustrate another embodiment of the present invention, in which a tie down assembly 710 includes a ring-shaped collar 711, a crossbar 714 attached to the collar 711, a funnel-shaped cover 712 having a recess 736, and a sleeve 717. In an embodiment, the collar 711, the crossbar 714, the cover 712, and the sleeve 717 are made from aluminum. In other embodiments, the cover 712 is made from other metallic or non-metallic materials. In an embodiment, the crossbar 714 is welded to a bottom surface of the collar 711, and the cover 712 envelopes the crossbar 714 and is welded to the bottom surface of the collar 711. In an embodiment, the collar 711 and the cap 716 are welded to the sleeve 717. In an embodiment, the tie down assembly 710 is welded to an aluminum deck (not shown in the Figures).

FIGS. 16A through 16D illustrate another embodiment of the present invention in which, a tie down assembly 810 includes a cylindrical-shaped base 812 having a circular-shaped recess 836, and a crossbar 814 positioned within the recess 836. In an embodiment, the tie down assembly 810 includes a hollow interior section 811 having ribbing 813 and a plurality of tabs 815. The ribbing 813 provides strength and stiffness, while allowing for mass reduction, of the tie down assembly 810. In an embodiment, the tie down assembly 810 is a unitary unit made by investment casting. In an embodiment, a circular-shaped close-out cover 816 is welded to the tabs 815. In an embodiment, a wear-coating substance is added to the crossbar 814 (not shown in the Figures). In an embodiment, the tie down assembly 810 is welded to an aluminum deck (not shown in the Figures).

FIGS. 17A through 17D illustrate another embodiment of the present invention, including a tie down assembly 910 includes a cylindrical-shaped base 912 having a recess 936, and a crossbar 814 positioned within the recess 936. In an embodiment, the tie down assembly 810 includes a hollow interior section 911 having a tab 915. In an embodiment, the tie down assembly 910 is a unitary unit made by machining. In an embodiment, a circular-shaped close-out cover 916 is welded to the tab 915. In an embodiment, a wear-coating substance is added to the crossbar 914 (not shown in the Figures). In an embodiment, the tie down assembly 910 is welded to an aluminum deck (not shown in the Figures).

Figure 18C:
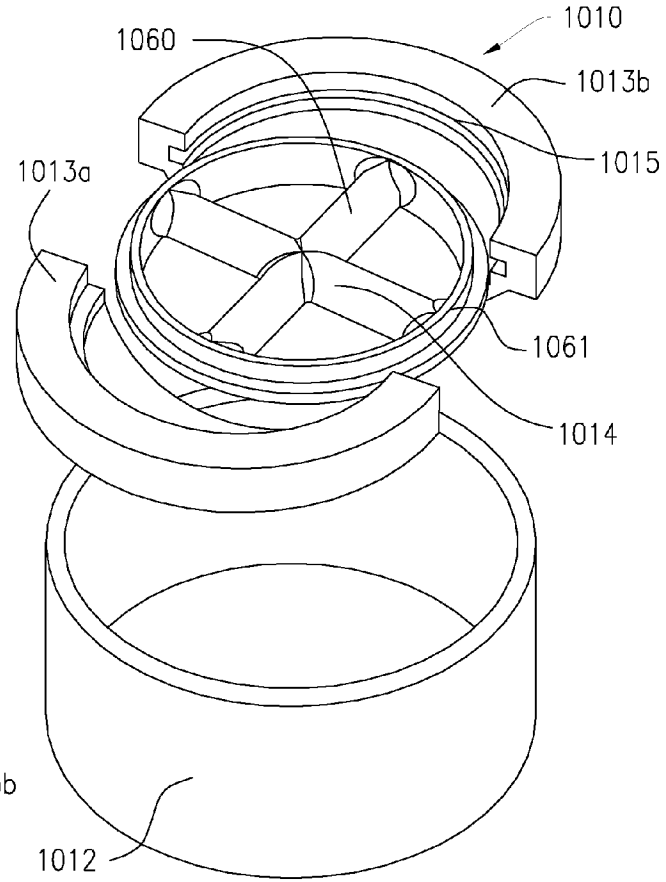
FIGS. 18A through 18C illustrate a tie down assembly in accordance with another embodiment of the present invention.
Figure 18A:
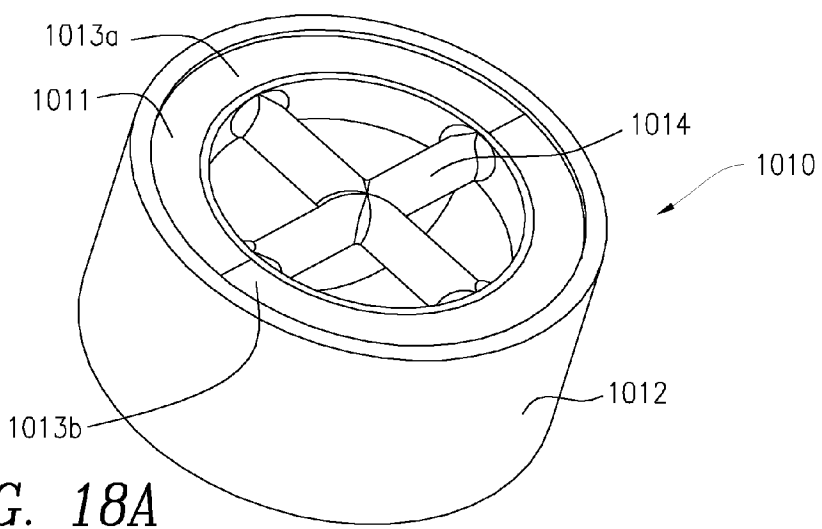
Figure 18B:
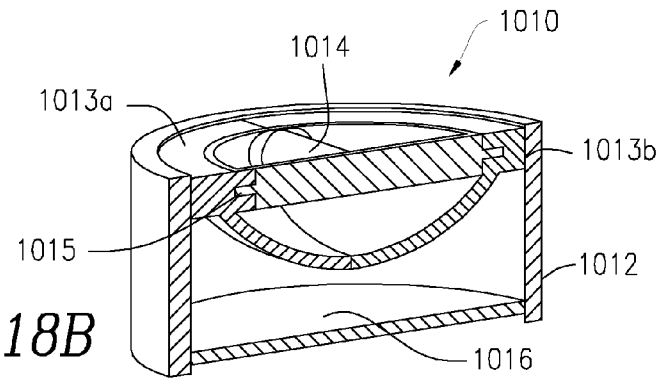

FIGS. 18A through 18C illustrate another embodiment of the present invention, in which a tie down assembly 1010 includes a tubular-shaped sleeve 1012, a collar 1011, and a crossbar 1014. In an embodiment, the collar 1011 includes two portions 1013*a*, 1013*b* that are sized and shaped to mate with one another, forming a circular-shaped groove 1015. In an embodiment, the crossbar 1014 includes a plurality of members 1060 and a ring 1061 that encircles the members 1060. In an embodiment, the ring 1061 is received within the groove 1015 of the collar 1011, thereby interlocking the crossbar 1014. In an embodiment, a bottom cap 1016 is welded to the sleeve 1012. In an embodiment, collar 1011, the crossbar 1014, and the sleeve 1012 are made from aluminum. In another embodiment, the crossbar 1014 is made from steel. In an embodiment, the crossbar 1014 is welded to the sleeve 1012. In an embodiment, the tie down assembly 1010 is welded to an aluminum deck (not shown in the Figures).

Figure 19B:
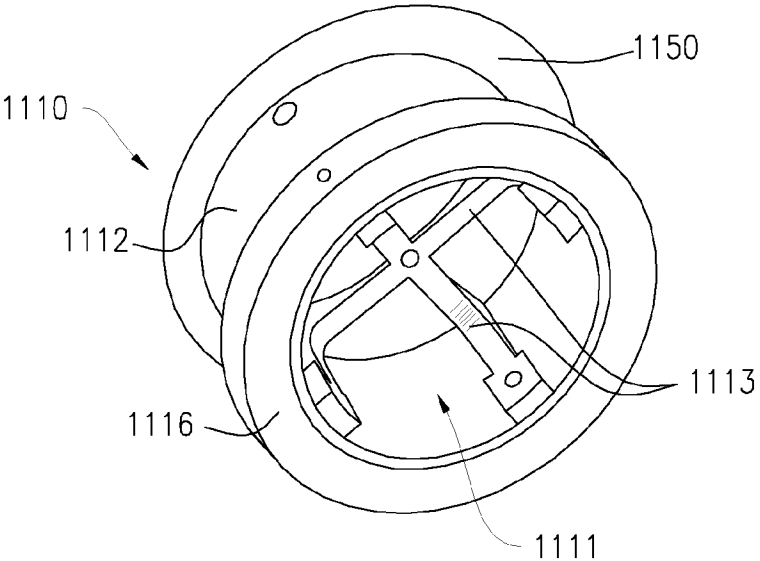
FIGS. 19A through 19C illustrate a tie down assembly in accordance with another embodiment of the present invention.
Figure 19A:
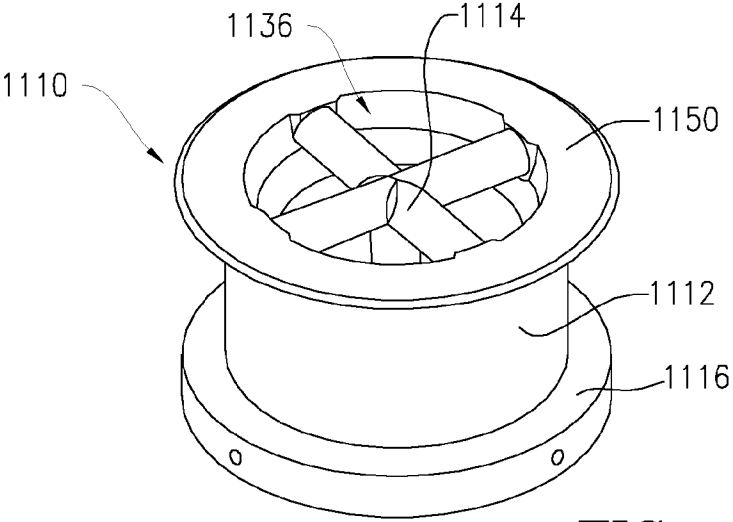
Figure 19C:
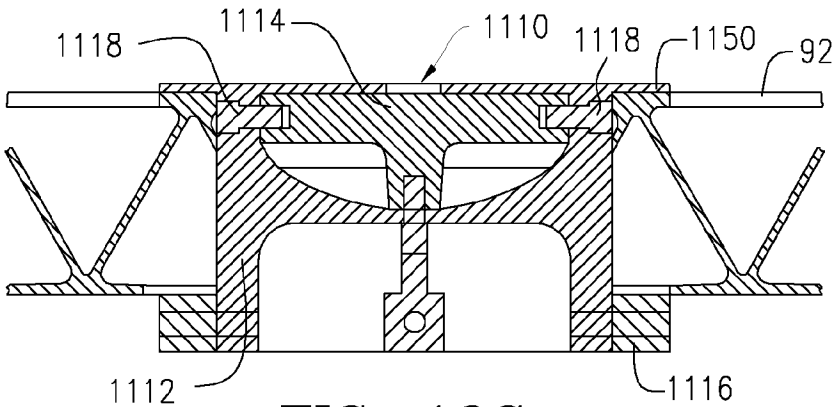

FIGS. 19A through 19C illustrate another embodiment of the present invention, in which a tie down assembly 1110 includes a tubular-shaped housing 1012 having a recess 1136 and a flange 1050, a cross-shaped crossbar 1114 mounted within the recess 1136 of the housing 1012 by a plurality of fasteners 1118, and a collar 1016 mounted to the housing by a plurality of tapered pins or keys (not specifically shown in the Figures), which compress the assembly 1110 together. In an embodiment, the housing 1012 includes a hollow, interior section 1111 that includes ribbing 1113 to provide stiffness and strength and allows for mass reduction. In an embodiment, the housing 1012 and the collar 1016 are made from aluminum, while the crossbar 1114 is made from steel. In an embodiment, the housing 1012 and the collar 1016 are machined. The tie down assembly 1110 is fastened to the aluminum deck 92 (see FIG. 19C).

Figure 20B:
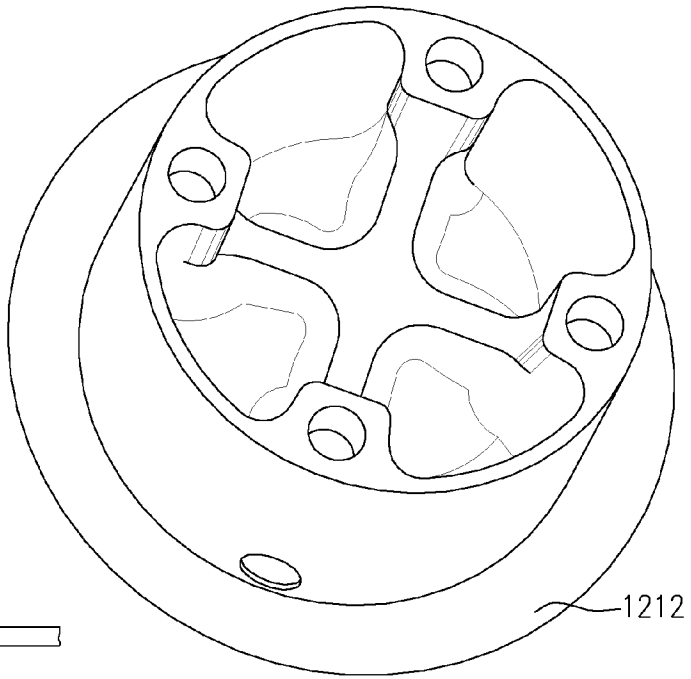
FIGS. 20A through 20C illustrate a tie down assembly in accordance with another embodiment of the present invention.
Figure 20A:
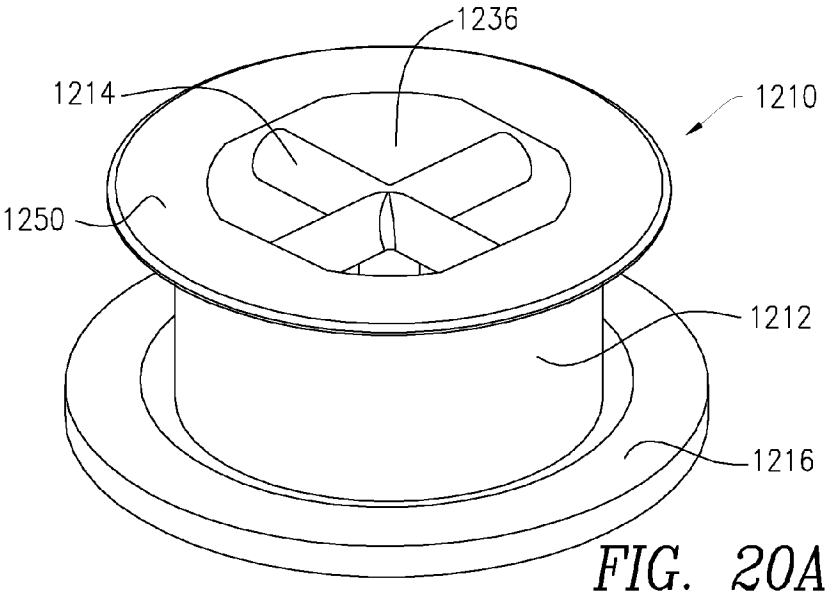
Figure 20C:
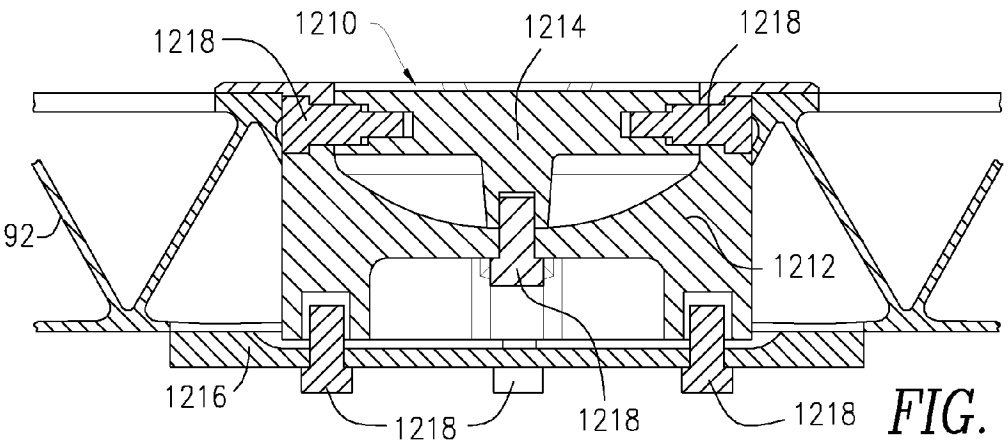

FIGS. 20A through 20C illustrate another embodiment of the present invention, in which a tie down assembly 1210 includes a cup 1212, a crossbar 1214, and a plate 1216 that is secured to the cup 1212 by a plurality of fasteners 1218. In an embodiment, the tie down assembly 1210 has a structure and function that are similar to the tie down assembly 10, except that the fasteners 1218 attaching the plate 1216 to the cup 1212 do not engage the crossbar 1214. The tie down assembly 1210 is installed within the deck 92 in a manner similar to that described above with respect to the tie down assembly 10 (see FIG. 9D).

It will be understood that the tie down assemblies described herein are merely exemplary and that a person skilled in the art may make many variations and modifications without departing from the full spirit and the scope of the embodiment described herein. For example, in an embodiment, the tie down assembly 10 includes failsafe components that enable the assembly 10 to fail prior to damaging the decking if overloaded, thereby saving high repair costs. In addition, in one or more embodiments, the tie down assemblies may be utilized in environments other than naval and maritime vessels, such as, for example, rail, aerospace, and motor vehicle transportation. Accordingly, all such variations and modifications are intended to be included within the scope of the invention as defined in the appended claims.

What is claimed is:

1. A tie down assembly adapted to be installed in a structure, comprising:

a cup having a first end, a second end opposite the first end, a recess formed within the first end and defining a sidewall having a plurality of apertures formed therein, a centrally-located aperture formed within the recess at the second end, and a stem extending from the second end and including an aperture that extends the length of the stem, the aperture of the stem being aligned with the centrally-located aperture of the recess;

a crossbar having a plurality of members each of which includes a first end having an aperture formed axially therein, each of the plurality of members being joined to one another at a central point, and a stem extending perpendicularly from the central point of the plurality of members, the stem of the crossbar including a first end with an aperture formed axially therein, the crossbar being positioned within the recess of the cup such that each of the apertures of the plurality of members of the crossbar aligns with a corresponding one of the plurality of apertures of the sidewall of the cup, each of the aligned apertures of the sidewall of the cup and the apertures of the plurality of members are sized and shaped to receive one of a first plurality of fasteners, and the stem of the crossbar aligns with the stem of the cup such that the aperture of the stem of the crossbar aligns with the aperture of the stem of the cup, the aligned aperture of the stem of the crossbar and the aperture of the stem of the cup are sized and shaped to receive a second fastener;

and a support plate having a first surface, a second surface opposite the first surface, and an aperture extending from the first surface to the second surface, the support plate being attached removably to the crossbar such that the aperture of the plate is sized and shaped to receive the second fastener.

2. The tie down assembly of claim 1, wherein the structure includes a first surface and a second surface opposite the first surface of the structure, the first surface of the structure including a first hole formed therein that is sized and shaped to receive the cup, and wherein the first surface of the support plate is juxtaposed with the second surface of the structure.

3. The tie down assembly of claim 2, wherein the second surface of the structure includes a second hole formed therein that is sized and shaped to receive the second fastener.

4. The tie down assembly of claim 3, wherein the cup includes a flange surrounding a perimeter of the recess and having a top surface and a bottom surface opposite the top surface, the flange of the cup rests on the first surface of the structure.

5. The tie down assembly of claim 4, wherein the bottom surface of the flange of the cup includes a groove formed therein that is sized and shaped to receive an O-ring.

6. The tie down assembly of claim 5, wherein the sidewall of the cup includes a plurality of tabs extending outwardly therefrom and positioned proximate to the bottom surface of the flange of the cup, and wherein the first surface of the structure includes a plurality of notches formed therein, each of the plurality of notches is sized and shaped to receive a corresponding one of the plurality of tabs of the cup so as to inhibit rotation of the tie down assembly relative to the first surface of the structure.

7. The tie down assembly of claim 1, wherein each of the apertures of the plurality of members includes internal threads for threadedly receiving a corresponding one of the first plurality of fasteners, and wherein the aperture of the stem of the crossbar includes internal threads for threadedly receiving the second fastener.

8. The tie down assembly of claim 1, wherein the cup and the support plate are each made from aluminum, and the crossbar is made from steel.

9. The tie down assembly of claim 1, wherein the plurality of members includes four of the members.

10. The tie down assembly of claim 9, wherein each of the plurality of members of the crossbar extends substantially in the same plane.

11. The tie down assembly of claim 10, further comprising a gasket positioned between the first end of the stem of the crossbar and the recess of the cup.

12. The tie down assembly of claim 11, wherein each of the first ends of the plurality of members includes a groove that is sized and shaped to receive an O-ring.

13. The tie down assembly of claim 1, wherein the first and second surfaces of the support plate are separated by a plurality of ribs.

14. The tie down assembly of claim 1, wherein the structure is made from aluminum.

15. The tie down assembly of claim 14, wherein the structure includes a deck of a vessel.

* * * * *